US009063446B2

(12) United States Patent
Miyaake et al.

(10) Patent No.: US 9,063,446 B2
(45) Date of Patent: Jun. 23, 2015

(54) TONER, DEVELOPER, IMAGE FORMING APPARATUS, AND IMAGE FORMING METHOD

(75) Inventors: Azumi Miyaake, Shizuoka (JP); Hideki Sugiura, Shizuoka (JP); Yuka Mizoguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/988,926

(22) PCT Filed: Nov. 2, 2011

(86) PCT No.: PCT/JP2011/075877

§ 371 (c)(1), (2), (4) Date: May 22, 2013

(87) PCT Pub. No.: WO2012/070388

PCT Pub. Date: May 31, 2012

(65) Prior Publication Data

US 2013/0244169 A1 Sep. 19, 2013

(30) Foreign Application Priority Data

Nov. 22, 2010 (JP) ..... 2010-260510
Oct. 25, 2011 (JP) ..... 2011-233534

(51) Int. Cl.
*G03G 9/087* (2006.01)
*G03G 9/08* (2006.01)
(Continued)

(52) U.S. Cl.
CPC ..... *G03G 9/08755* (2013.01); *G03G 9/0821* (2013.01); *G03G 9/08782* (2013.01); *G03G 9/08791* (2013.01); *G03G 9/08793* (2013.01); *G03G 9/08795* (2013.01); *G03G 9/08797* (2013.01); *G03G 13/20* (2013.01); *G03G 15/20* (2013.01)

(58) Field of Classification Search
USPC ..... 430/109.4, 123.54; 399/222
See application file for complete search history.

(56) References Cited

U.S. PATENT DOCUMENTS 7,166,403 B2 1/2007 Ichikawa et al.
7,261,989 B2 8/2007 Sugiura et al.
(Continued)

FOREIGN PATENT DOCUMENTS

JP 04-070765 3/1992
JP 2004-245854 9/2004
(Continued)

OTHER PUBLICATIONS

Diamond, "The Handbook of Imaging Materials," Marcel Dekker, NY, NY 1991. pp. 380-382.*
(Continued)

*Primary Examiner* — Peter Vajda
(74) *Attorney, Agent, or Firm* — Oblon, McClelland, Maier & Neustadt, L.L.P.

(57) ABSTRACT

To provide a toner, which contains: a binder resin; a colorant; and wax, wherein the toner has Ta of 30° C. to 55° C., and Tb−Ta of 8° C. to 25° C., where Ta is a glass transition temperature of the toner determined from a constant heating component of a DSC curve of the toner obtained in a second heating process of temperature modulated differential scanning calorimetry, and Tb is a glass transition temperature of the toner determined from a constant heating component of a DSC curve of the toner obtained in a first heating process of temperature modulated differential scanning calorimetry.

15 Claims, 4 Drawing Sheets

(51) Int. Cl.
*G03G 13/20* (2006.01)
*G03G 15/20* (2006.01)

(56) References Cited

U.S. PATENT DOCUMENTS

| | | | | |
|---|---|---|---|---|
| 7,318,989 | B2 | 1/2008 | Kotsugai et al. | |
| 7,374,851 | B2 | 5/2008 | Nakayama et al. | |
| 7,405,000 | B2 | 7/2008 | Takikawa et al. | |
| 7,455,942 | B2 | 11/2008 | Nagatomo et al. | |
| 7,664,439 | B2 | 2/2010 | Sugiura | |
| 7,745,084 | B2 | 6/2010 | Sugiura et al. | |
| 7,759,036 | B2 | 7/2010 | Utsumi et al. | |
| 8,007,976 | B2 | 8/2011 | Sugiura et al. | |
| 8,043,780 | B2 | 10/2011 | Sugiura et al. | |
| 2004/0265721 | A1* | 12/2004 | Matsuoka et al. | 430/109.4 |
| 2006/0057488 | A1 | 3/2006 | Inoue et al. | |
| 2006/0204880 | A1* | 9/2006 | Mizutani et al. | 430/109.4 |
| 2007/0059063 | A1 | 3/2007 | Nakayama et al. | |
| 2008/0014527 | A1 | 1/2008 | Kotsugai et al. | |
| 2008/0268366 | A1 | 10/2008 | Nakayama et al. | |
| 2009/0142110 | A1 | 6/2009 | Oya et al. | |
| 2011/0003244 | A1 | 1/2011 | Inoue et al. | |
| 2011/0097659 | A1 | 4/2011 | Sugiura et al. | |

FOREIGN PATENT DOCUMENTS

| | | |
|---|---|---|
| JP | 2005-037901 | 2/2005 |
| JP | 2006-065025 | 3/2006 |
| JP | 2006-084743 | 3/2006 |
| JP | 2006-208609 | 8/2006 |
| JP | 2006-251564 | 9/2006 |
| JP | 2006-337872 | 12/2006 |
| JP | 2007-079329 | 3/2007 |
| JP | 2009-104193 | 5/2009 |
| JP | 2009-109971 | 5/2009 |
| JP | 2009-139408 | 6/2009 |
| JP | 4389665 | 10/2009 |
| JP | 2010-139696 | 6/2010 |

OTHER PUBLICATIONS

International Search Report Issued Dec. 27, 2011 in PCT/JP2011/075877 Filed Nov. 2, 2011.

Office Action issued Mar. 16, 2015 in Japanese Patent Application No. 2011233534 filed Oct. 25, 2011 w/English translation.

* cited by examiner

TONER, DEVELOPER, IMAGE FORMING APPARATUS, AND IMAGE FORMING METHOD

TECHNICAL FIELD

The present invention relates to a toner, a developer, an image forming apparatus, and an image forming method.

BACKGROUND ART

With an electrophotographic device or electrostatic recording device, a toner image is formed by depositing a toner on a latent electrostatic image formed on a photoconductor, transferring the deposited toner to a transfer material, and fixing the transferred toner with heat onto the transfer material such as paper. Moreover, a full-color image formation is generally a reproduction of a color with toners of four colors, black, yellow, magenta, and cyan, and form a full-color image by developing each color, and heating a toner image formed by laminating a layer of each toner on a transfer material, to fix the toner image.

The toner used in such image formation is desired to have excellent low temperature fixing ability corresponding to the development of the electrophotographic technology. For giving a toner low temperature fixing ability, a method where a glass transition temperature of a binder resin used in a toner is simply reduced is used, but this adversely affect storage stability of the toner.

Accordingly, various attempts have been made to use a polyester resin, which has high compatibility and excellent low temperature fixing ability compared to a styrene-based resin generally used as a binder resin of a toner in the conventional art, in a toner.

For example, as proposed toners, there are a toner containing a linear polyester resin whose physical properties, such as a molecular weight is specified (see PTL1), and a toner containing a non-linear crosslinked polyester resin using rosins as an acid component (see PTL2).

The toner containing the polyester resin using the rosins as mentioned has excellent low temperature fixing ability, as well as excellent grindability, and therefore it has an advantage that the toner production thereof by a pulverization method can be improved.

Moreover, by using 1,2-propanediol, which is C3 branched chain alcohol, as an alcohol component of the polyester resin, the low temperature fixing ability of the resulting toner can be improved while maintaining offset resistance of the toner, compared to the case where C2 or lower alcohol is used. Compared to the case where a C4 or higher branched alcohol is used, use of such an alcohol is more effective in preventing the storage stability from being deteriorated along with the reduction in the glass transition temperature.

By using the aforementioned polyester resin as a binder resin for a toner, the resulting toner has effects that fixing can be performed at low temperature, and that storage stability thereof improves.

Recently, there have been trends to further increase processing speed of image forming apparatuses, and to saving more energy required for operating image forming apparatuses. Under such circumstances, the conventional techniques mentioned above are not sufficient. Specifically, with the conventional techniques, it is extremely difficult to maintain sufficient fixation strength, i.e., image maintainability, because of reduced fixing duration during a fixing process, and lowered heating temperature by a fixing unit.

To solve these problems, there has been proposed a technique where low temperature fixing ability of a toner is improved by introducing as a fixing auxiliary substance, a plasticizer compatible with a resin during heating (see PTL3).

This proposed technique achieves both heat resistance storage stability and low temperature fixing ability of a toner by designing the toner to have the fixing auxiliary substance as a crystalline domain.

However, this technique has a problem that the resulting toner does not have sufficient image maintainability.

Moreover, there has been disclosed a toner which achieves both heat resistance storage stability and low temperature fixing ability by introducing a crystalline polyester resin therein (see PTL4, and PTL5).

However, with the proposed technique, the glass transition temperature of the toner reduces after heating, because of the introduced crystalline polyester resin, which adversely affects image maintainability of the toner.

Accordingly, there is currently a demand for a toner having excellent low temperature fixing ability, heat resistance storage stability, and image maintainability, as well as a developer, image forming apparatus and image forming method all of which use such a toner.

CITATION LIST

Patent Literature

PTL 1 Japanese Patent Application Laid-Open (JP-A) No. 2004-245854
PTL 2 JP-A No. 04-70765
PTL 3 JP-A No. 2006-208609
PTL 4 JP-A No. 2009-109971
PTL 5 JP-A No. 2006-337872

SUMMARY OF INVENTION

Technical Problem

The present invention aims to solve the various problems in the art, and to achieve the following object. Namely, the object of the present invention is to provide a toner having excellent low temperature fixing ability, heat resistance storage stability, and image maintainability, and to provide a developer, an image forming apparatus, and an image forming method, all of which use the aforementioned toner.

Solution to Problem

The means for solving the aforementioned problems are as follows:

<1> A toner containing:

a binder resin;

a colorant; and wax, wherein the toner has Ta of 30° C. to 55° C., and Tb−Ta of 8° C. to 25° C., where Ta is a glass transition temperature of the toner determined from a constant heating component of a DSC curve of the toner obtained in a second heating process of temperature modulated differential scanning calorimetry, where the temperature modulated differential scanning calorimetry is performed by heating the toner from 0° C. to 150° C. at a heating rate of 3° C./min, and a modulation cycle of 0.5° C./60 sec, cooling from 150° C. to 0° C. at a cooling rate of 20° C./min, and a modulation cycle of 0.5° C./60 sec, followed by heating from 0° C. to 150° C. at a heating rate of 3° C./min, and a modulation cycle of 0.5° C./60 sec, and Tb is a glass transition temperature of the toner determined from a constant heating component of a DSC curve of the toner obtained in a first heating process of temperature modulated differential scanning calorimetry, where the temperature modulated differential scanning calorimetry is performed, after heating the toner to 150° C. at a heating rate of 10° C./min by a differential scanning calorimeter, and self-cooling and leaving the toner to stand for 1 month, by heating the toner from 0° C. to 150° C. at a heating rate of 3° C./min, and a modulation cycle of 0.5° C./60 sec.

<2> The toner according to <1>, wherein the toner has Tb−Ta of 10° C. to 20° C.

<3> The toner according to any of <1> or <2>, wherein the binder resin contains at least a crystalline resin.

<4> The toner according to <3>, wherein the crystalline resin is a crystalline polyester resin.

<5> The toner according to any one of <1> to <4>, wherein the binder resin contains at least a modified polyester resin.

<6> The toner according to any one of <1> to <5>, wherein the binder resin contains a polyester resin which contains a chloroform insoluble component in an amount of 10% by mass to 40% by mass.

<7> A developer, comprising the toner as defined in any one of <1> to <6>.

<8> An image forming apparatus, containing:

a latent electrostatic image bearing member;

a latent electrostatic image forming unit configured to form a latent electrostatic image on the latent electrostatic image bearing member;

a developing unit configured to develop the latent electrostatic image with the toner as defined in any one of <1> to <6> to form a visible image;

a transferring unit configured to transfer the visible image to a recording medium; and a fixing unit configured to fix the transferred image onto the recording medium.

<9> An image forming method, containing:

forming a latent electrostatic image on a latent electrostatic image bearing member;

developing the latent electrostatic image with the toner as defined in any one of <1> to <6> to form a visible image;

transferring the visible image to a recording medium; and fixing the transferred image onto the recording medium.

Advantageous Effects of Invention

The present invention can solve the various problems in the art, and provides a toner having excellent low temperature fixing ability, heat resistance storage stability, and image maintainability, as well as providing a developer, an image forming apparatus, and an image forming method all of which use such a toner.

DESCRIPTION OF EMBODIMENTS (Toner)

The toner of the present invention contains at least a binder resin, a colorant, and wax, and may further contain other components, if necessary.

The toner has Ta of 30° C. to 55° C., and Tb−Ta of 8° C. to 25° C., where Ta is a glass transition temperature determined from a constant heating component of a DSC curve of the toner obtained in a second heating process of temperature modulated differential scanning calorimetry (DSC) of the toner, and Tb is a glass transition temperature determined from a constant heating component of a DSC curve of the toner obtained in a first heating process of temperature modulated DSC of the toner, performed after heating and leaving to stand at room temperature.

Specifically, the glass transition temperature Ta is a glass transition temperature of the toner determined from a constant heating component of a DSC curve of the toner obtained in a second heating process of temperature modulated differential scanning calorimetry (DSC), where the temperature modulated DSC is performed by heating the toner from 0° C. to 150° C. at a heating rate of 3° C./min, and a modulation cycle of 0.5° C./60 sec, cooling from 150° C. to 0° C. at a cooling rate of 20° C./min, and a modulation cycle of 0.5° C./60 sec, followed by heating from 0° C. to 150° C. at a heating rate of 3° C./min, and a modulation cycle of 0.5° C./60 sec.

The glass transition temperature Tb is a glass transition temperature of the toner determined from a constant heating component of a DSC curve of the toner obtained in a first heating process of temperature modulated differential DSC, where the temperature modulated DSC is performed, after heating the toner to 150° C. at a heating rate of 10° C./min by a differential scanning calorimeter, and self-cooling and leaving the toner to stand for 1 month, by heating the toner from 0° C. to 150° C. at a heating rate of 3° C./min, and modulation cycle of 0.5° C./60 sec.

<Ta and Tb>

The glass transition temperature Ta is a glass transition temperature determined from a constant heating component of a DSC curve of the toner obtained in a second heating process of temperature modulated DSC of the toner.

The glass transition temperature Tb is a glass transition temperature determined from a constant heating component of a DSC curve of the toner obtained in a first heating process of temperature modulated DSC of the toner, performed after heating and leaving the toner to stand at room temperature.

The glass transition temperatures Ta and Tb can be measured by the following methods.

Figure 1:
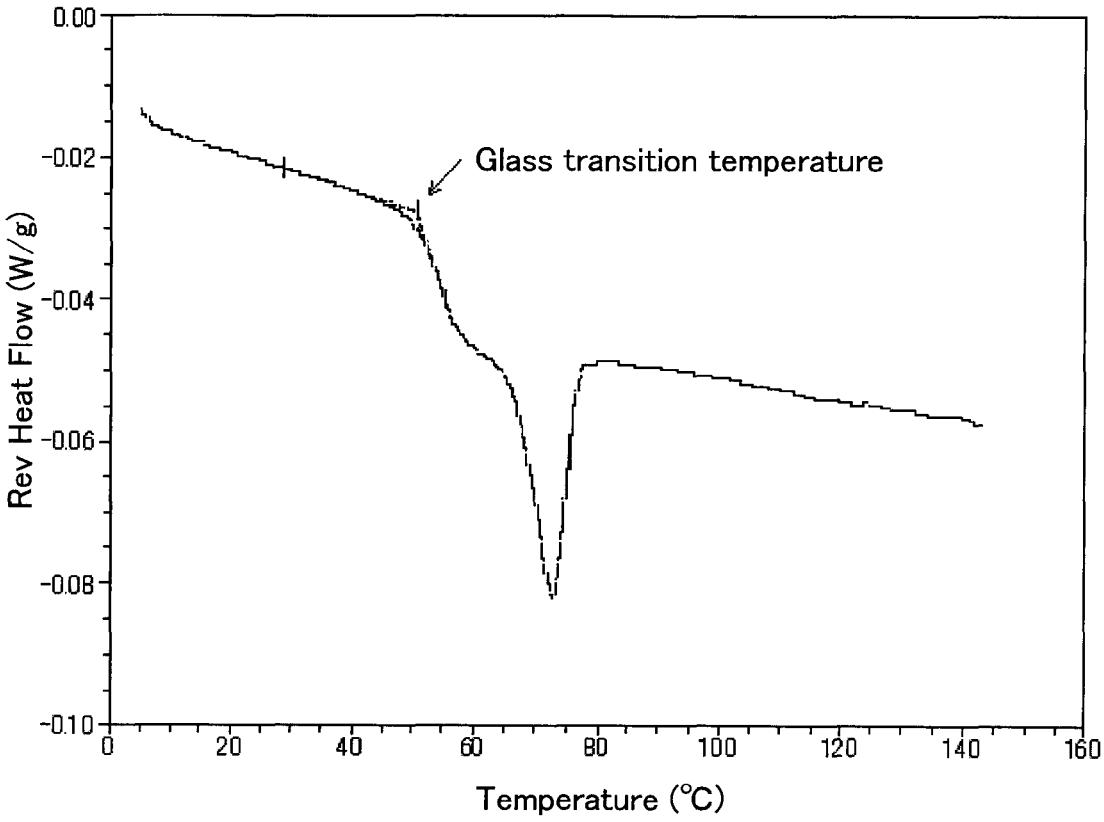
FIG. 1 is a graph illustrating an example of a measurement of the toner by temperature modulated DSC.

For the measurement, temperature modulated DSC is used. For the temperature modulated DSC, for example, a differential scanning calorimeter Q200 (manufactured by TA Instruments Japan Inc.) can be used. FIG. 1 illustrates an example of a measurement of the toner by TM-DSC.

Specifically as the measuring method of the glass transition temperature Ta, the following operations are carried out. At first, about 5.0 mg of the toner is placed in an aluminum sample container. The sample container is placed on a holder unit, and set in an electric furnace. Next, in a nitrogen atmosphere, the sample is heated from 0° C. to 150° C. at a heating rate of 3° C./min, and a modulation cycle of 0.5° C./60 sec, to thereby obtain a DSC curve of a first heating process. Sequentially, the sample is cooled from 150° C. to 0° C. at a cooling rate of 20° C./min, and a modulation cycle of 0.5° C./60 sec, followed by heating from 0° C. to 150° C. at a heating rate of 3° C./min, and modulation cycle of 0.5° C./60 sec, to thereby obtain a DSC curve of a second heating process. A constant heating component is selected from the DSC curve of the second heating process, and glass transition temperature thereof is determined by an analysis program, TA Universal Analysis (of TA Instruments Japan Inc.). In the manner as mentioned, the glass transition temperature Ta can be measured.

Specifically as the measuring method of the glass transition temperature Tb, the following operations are carried out. At first, about 5.0 mg of the toner is placed in an aluminum sample container. The toner in the sample container is heated to 150° C. by the differential scanning calorimeter at a heating rate of 10° C./min, followed by self-cooled, and left to stand for 1 month at room temperature. After heating, the state of the toner changes by time. By leaving the toner to stand for 1 month, a stable crystalline state of the binder resin can be accurately determined. Then, the aluminum sample container is set in an electric furnace. Next, in a nitrogen atmosphere, the sample is heated from 0° C. to 150° C. at a heating rate of 3° C./min, and a modulation cycle of 0.5° C./60 sec, to thereby obtain a DSC curve of a first heating process. A constant heating component is selected from the DSC curve of the first heating process, and glass transition temperature thereof is determined by an analysis program, TA Universal Analysis (of TA Instruments Japan Inc.). In the manner as mentioned, the glass transition temperature Tb can be measured.

Here, "the toner, after heating and leaving to stand" means the toner which has been heated to the temperature at which the substances in the toner are completely melted, followed by being self-cooled, and left to stand. "The temperature at which the substances in the toner are completely melted" means a temperature at which the binder resin and the wax contained in the toner are completely melted, and note that it does not mean that inorganic components such as external additives and the colorant need to be melted at the aforementioned temperature. Specific examples of the method for leaving the toner to stand at room temperature after heating include, as mentioned above, after heating the toner to 150° C. by a differential scanning calorimeter at a heating rate of 10° C./min, self-cooling the toner, and leaving the toner to stand for 1 month.

In the present specification, the term "room temperature" indicates the temperature ranging from 20° C. to 25° C.

In the present invention, the glass transition temperature of the toner is measured by temperature modulated DSC, not by commonly used DSC. This is because an endothermic peak attributed from a glass transition temperature overlaps with a thermal relaxation peak in common DSC so that the accurate glass transition temperature cannot be determined. In the temperature modulated DSC, the thermal relaxation peak can be reparated, and therefore a glass transition temperature can be measured more accurately.

In the present invention, the glass transition temperature Ta is determined from the second heating process of temperature modulated DSC, not from the first heating process thereof, in order to measure the glass transition temperature of the toner whose state is completely melted as heat has been already applied once.

Moreover, the heating is performed at the heating rate of 3° C./min, and the modulation cycle of 0.5° C./60 sec, because these conditions are suitable for separating the constant heating component from the modulated temperature component.

In the present invention, the glass transition temperature Tb is determined from the constant heating component of the DSC curve of the toner obtained in the first heating process of the temperature modulated DSC of the toner, performed after heating and leaving the toner to stand at room temperature. This is because, if the toner is heated, then left to stand for a while, the state of the toner changes, for example, due to recrystallization of the crystalline resin, compared to the state thereof just after the heating.

By measuring the value of Tb−Ta, a change in a state of the toner after being heated can be determined. The value of Tb−Ta is interpreted as a measure of a recovering degree of a toner (i.e., a recrystallization degree of the crystalline polyester resin) at the time when the toner is left at room temperature after heating the toner to decrease the crystallinity of the crystalline polyester resin and to turn into a state where an imaging surface formed of the toner tends to stick.

When the glass transition temperature Ta of the toner is lower than 30° C., the toner may have insufficient heat resistance storage stability and image maintainability.

When the glass transition temperature Ta of the toner is higher than 55° C., the toner may have insufficient low temperature fixing ability.

When the value of Tb−Ta is less than 8° C., the toner may have insufficient low temperature fixing ability and image maintainability.

When the value of Tb−Ta is more than 25° C., the toner may have insufficient heat resistance storage stability.

The glass transition temperature Ta of the toner is preferably 52° C. or lower.

The value of Tb−Ta is preferably 10° C. to 20° C.

When the value of Tb−Ta, and the glass transition temperature Ta are in the preferable ranges, i.e., Tb−Ta is 10° C. to 20° C., and Ta is 30° C. to 52° C., the resulting toner has excellent properties in terms of all of low temperature fixing ability, heat resistance storage stability, and image maintainability.

Ta of the toner can be controlled by adjusting the composition, formulation, or the like of the binder resin contained in the toner. For example, the toner has the higher Ta when the binder resin contains the larger proportion of high molecular component.

The value of Tb−Ta can be controlled by adjusting the composition, formulation, or the like of the binder resin contained in the toner. For example, the value of Tb−Ta is larger when an amount of the crystalline resin (e.g., a crystalline polyester resin) is larger.

Moreover, the value of Tb−Ta can be made even larger, by using a combination of the crystalline resin and a modified polyester resin obtained by an elongation reaction, or using the polyester resin (e.g., an unmodified polyester resin, and a modified polyester resin) containing a chloroform insoluble component in an amount of 10% by mass to 40% by mass.

The chloroform insoluble component can be measured, for example, by the following method.

One gram of the resin is weight and taken as a sample, and about 50 g of chloroform is added to the sampled resin. After sufficiently mixing the mixture, the resulting liquid is subjected to centrifugal separation, followed by filtration with a filter paper to thereby separate into a liquid component, and solids. The residual solids on the filter paper are an insoluble component. Based on the amount of the residual solids on the filter paper relative to 1 g of the resin, the chloroform insoluble component (% by mass) is determined.

The toner is different from conventional toners, for example, in that an amount of the crystalline resin (e.g., a crystalline polyester resin) is large, and/or that use of a combination of the crystalline resin (e.g., a crystalline polyester resin) and the modified polyester resin or high molecular weight binder resin. Moreover, by containing the large amount of the crystalline resin, and/or using a certain combination of the resins, the toner whose Ta, and Tb−Ta fallen into the ranges specified above is attained.

<Binder Resin>

The binder resin is appropriately selected depending on the intended purpose without any restriction. For example, the binder resin contains at least a crystalline resin, and may further contain other resins such as a non-crystalline polyester resin, if necessary.

It is preferred that the entire or part of the binder resin be a crystalline resin for producing a toner having excellent low temperature fixing ability.

Moreover, the binder resin preferably contains a polyester resin a chloroform insoluble component of which is in an amount of 10% by mass to 40% by mass. The polyester resin is appropriately selected depending on the intended purpose without any restriction, but it is preferably the unmodified polyester resin described later because of easiness in controlling the value of Tb−Ta.

—Crystalline Resin—

The crystalline resin is appropriately selected depending on the intended purpose without any restriction as long as it is a resin having crystallinity. Examples thereof include a crystalline polyester resin, and a crystalline vinyl-based resin. Among them, the crystalline polyester resin is preferable in view of fixing ability to paper during fixing, charging ability, and easiness in controlling a melting point.

—Crystalline Polyester Resin—

The crystalline polyester resin is formed from a polyhydric alcohol component, and a polycarboxylic acid component (e.g. polycarboxylic acid, polycarboxylic acid anhydride, and polycarboxylic acid ester).

The polyhydric alcohol component is appropriately selected depending on the intended purpose without any restriction. Examples thereof include a saturated aliphatic diol compound. Examples of the saturated aliphatic diol compound include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

These may be used independently, or in combination.

Among them, a saturated C2-C12 straight-chain aliphatic diol compound is preferable. When the saturated aliphatic diol compound has a branched chain structure, the resulting crystalline polyester resin has low crystallinity, reducing a melting point thereof. Therefore, use thereof in the toner may result in insufficient low temperature fixing ability, heat resistance storage stability, and image maintainability of the toner.

The polycarboxylic acid component is appropriately selected depending on the intended purpose without any restriction. Examples thereof include aliphatic dicarboxylic acid, aromatic dicarboxylic acid, anhydrides thereof, lower alkyl ester thereof, and tri or higher polycarboxylic acid.

Examples of the aliphatic dicarboxylic acid include oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid.

Examples of the aromatic dicarboxylic acid include phthalic acid, isophthalic acid, terephthalic acid, naphthalene-2,6-dicarboxylic acid, malonic acid, and mesaconic acid.

Examples of the tri or higher polycarboxylic acid include 1,2,4-benzenetricarboxylic acid, 1,2,5-benzenetricarboxylic acid, 1,2,4-naphthalenetricarboxylic acid, anhydrides thereof, and lower alkyl esters thereof.

These may be used independently, or in combination.

Among them, a C2-C12 dicarboxylic acid is preferable as the polycarboxylic acid component.

The crystalline polyester resin may be selected from commercial products, or appropriately synthesized for use.

A production method of the crystalline polyester resin is not particularly limited, and can be produced by a conventional polymerization method of polyester where the polycarboxylic acid component is reacted with the polyhydric alcohol component. Examples of the production method thereof include direct polycondensation, and ester interchange. The crystalline polyester resin can be produced by any of these method appropriately selected depending on monomers for use.

The production of the crystalline polyester resin can be performed, for example, at the polymerization temperature of 180° C. to 230° C., optionally with reducing the internal pressure of a reaction system to thereby proceed to a reaction while removing water or alcohol generated by the condensation.

In the case where the polycarboxylic acid component or polyhydric alcohol component (monomer) is not dissolved, or is not made compatible at the reaction temperature, a solvent having a high boiling point may be added as a solubilizing agent to dissolve the component.

The polycondensation reaction is preferably performed with removing the solubilizing agent.

In the case where there is a monomer having poor compatibility in a copolymerization reaction, such a poorly compatible monomer be condensed in advance with the polycarboxylic acid component or polyhydric alcohol component to be polycondensed, and then the resultant can be subjected to polycondensation together with the main components.

The catalyst usable in the synthesis of the crystalline polyester resin includes: an alkali metal compound such as sodium, and lithium; an alkali earth metal compound such as magnesium, and calcium; a metal compound such as zinc, manganese, antimony, titanium, tin, zirconium, and germanium; and others such as a phosphorous acid compound, a phosphoric acid, and an amine compound.

A melting temperature (i.e. melting point) of the crystalline resin is appropriately selected depending on the intended purpose without any restriction, but it is preferably 50° C. to 100° C., more preferably 60° C. to 80° C. When the melting point thereof is lower than 50° C., there may be a problem in storage stability of the toner, or in storage stability of the toner image after fixing. When the melting point thereof is higher than 100° C., the resulting toner may not have sufficient low temperature fixing ability compared to conventional toners.

Note that, the melting temperature of the crystalline resin in the toner can be observed as a melting peak in the first heating process (i.e. the initial heating process) in the DSC analysis.

—Non-Crystalline Polyester Resin—

The non-crystalline polyester resin is appropriately selected depending on the intended purpose without any restriction. Examples thereof include an unmodified polyester resin, and a modified polyester resin.

—Unmodified Polyester Resin—

The unmodified polyester resin is a non-crystalline polyester resin, and can be formed from a polyhydric alcohol component, and a polycarboxylic acid component (e.g. polycarboxylic acid, polycarboxylic acid anhydride, and polycarboxylic acid ester).

The polyhydric alcohol component is appropriately selected depending on the intended purpose without any restriction. Examples thereof include aliphatic diols, alicyclic diols, and aromatic diols.

Examples of the aliphatic diols include ethylene glycol, diethylene glycol, triethylene glycol, propylene glycol, butanediol, hexanediol, neopentyl glycol, and glycerin.

Examples of the alicyclic diols include cyclohexane diol, cyclohexane dimethanol, and hydrogenated bisphenol A.

Examples of the aromatic diols include an ethylene oxide adduct of bisphenol A, and a propylene oxide adduct of bisphenol A.

These may be used independently, or in combination.

The polycarboxylic acid component is appropriately selected depending on the intended purpose without any restriction. Examples thereof include aromatic carboxylic acids, aliphatic carboxylic acids, and alicyclic carboxylic acids.

Examples of the aromatic carboxylic acids include terephthalic acid, isophthalic acid, phthalic anhydride, trimellitic anhydride, pyromellitic acid, and naphthalene dicarboxylic acid.

Examples of the aliphatic carboxylic acids include maleic anhydride, fumaric acid, succinic acid, alkenyl succinic anhydride, and adipic acid.

Examples of the alicyclic carboxylic acids include cyclohexane dicarboxylic acid.

These may be used independently, or in combination.

A peak molecular weight of the unmodified polyester resin is appropriately selected depending on the intended purpose without any restriction, but it is preferably 1,000 to 30,000, more preferably 1,500 to 10,000, and even more preferably 2,000 to 8,000. When the peak molecular weight thereof is smaller than 1,000, the resulting toner may have insufficient heat resistance storage stability. When the peak molecular weight thereof is larger than 30,000, the resulting toner may have insufficient low temperature fixing ability.

An acid value of the unmodified polyester resin is appropriately selected depending on the intended purpose without any restriction. The acid value thereof is preferably 1 mgKOH/g to 30 mgKOH/g, more preferably 5 mgKOH/g to 20 mgKOH/g. With such an acid value, the resulting toner is easily negatively charged.

A hydroxyl value of the unmodified polyester resin is appropriately selected depending on the intended purpose without any restriction. The hydroxyl value thereof is preferably 5 mgKOH/g or higher, more preferably 10 mgKOH/g to 120 mgKOH/g, and even more preferably 20 mgKOH/g to 80 mgKOH/g. When the hydroxyl value thereof is lower than 5 mgKOH/g, there may be a problem in attaining both heat resistance storage stability and low temperature fixing ability of the toner.

—Modified Polyester Resin—

The binder resin preferably contains a modified polyester resin.

The modified polyester resin is a non-crystalline polyester resin, and is a polyester resin in which there is a bond, other than an ester bond, binding to a functional group contained in the monomer unit of the acid or alcohol, or there are resin components having different structures, and bonded together with a covalent bond or ionic bond.

The modified polyester resin is, for example, a polyester resin a terminal of which is reacted to bond, other than ester bonding. Specific examples thereof include resins (e.g., a urea-modified polyester resin, and urethane-modified polyester resin) obtained by reacting a compound containing an active hydrogen group with a polyester resin containing a functional group reactive with the active hydrogen group of the compound to proceed to elongation reaction and/or crosslink reaction.

Another examples include polyester resins (e.g., styrene-modified polyester resin, and acryl-modified polyester resin) in which a graft component of a C—C bond is introduced into a side chain of a polyester resin by introducing a reactive group (e.g. a carbon double bond) is introduced into a principle chain of a polyester resin, and inducing a radical polymerization from the reactive group, or in which carbon double bonds are bridged to each other.

Yet another examples include those copolymerizing a resin component having a different structure with a principle chain of a polyester resin, and those reacting a terminal (e.g. a carboxyl group and hydroxyl group) of a resin component having a different structure, which are, for example, polyester resins copolymerized with a silicone resin terminals of which are modified with a carboxyl group, a hydroxyl group, an epoxy group, and a mercapto group (e.g. a silicone modified polyester resin).

—Compound Containing Active Hydrogen Group—

The compound containing an active hydrogen group functions as an elongation agent, or crosslinking agent in an aqueous medium during an elongation reaction or crosslink reaction of a polyester resin containing a functional group reactive with the compound containing an active hydrogen group.

The compound containing an active hydrogen group is appropriately selected depending on the intended purpose without any restriction, provided that it contains an active hydrogen group. For example, in the case where the polyester resin containing a functional group reactive with the compound containing an active hydrogen group is polyester prepolymer (A) containing an isocyanate group, the compound containing an active hydrogen group is preferably amines (B), as they can be yield a high molecular weight resin by a reaction (e.g., an elongation reaction, crosslink reaction, etc.) with the polyester prepolymer (A) containing an isocyanate group.

The active hydrogen group is appropriately selected depending on the intended purpose without any restriction. Examples thereof include a hydroxyl group (e.g., alcoholic hydroxyl group, and phenolic hydroxyl group), an amino group, a carboxyl group, and a mercapto group. These may be used independently, or in combination.

The amines (B) are appropriately selected depending on the intended purpose without any restriction. Examples thereof include diamine (B1), tri, or higher polyamine (B2), amino alcohol (B3), aminomercaptan (B4), amino acid (B5), and a blocked compound (B6) where an amino group of any of the foregoing B1 to B5 is blocked. These may be used independently, or in combination.

Among them, as the amines, the diamine (B1) alone, or a mixture of the diamine (B1) with a small amount of the tri or higher polyamine (B2) are particularly preferable.

The diamine (B1) is appropriately selected depending on the intended purpose without any restriction. Examples thereof include aromatic diamine, alicyclic diamine, and aliphatic diamine. Examples of the aromatic diamine include phenylene diamine, diethyl toluene diamine, and 4,4'-diaminodiphenyl methane. Examples of the alicyclic diamine include 4,4'-diamino-3,3'-dimethyldichlorohexyl methane, diamine cyclohexane, and isophorone diamine. Examples of the aliphatic diamine include ethylene diamine, tetramethylene diamine, and hexamethylene diamine.

The tri or higher polyamine (B2) is appropriately selected depending on the intended purpose without any restriction. Examples thereof include diethylene triamine, and triethylene tetramine.

The amino alcohol (B3) is appropriately selected depending on the intended purpose without any restriction. Examples thereof include ethanol amine, and hydroxyethyl aniline.

The aminomercaptan (B4) is appropriately selected depending on the intended purpose without any restriction. Examples thereof include aminoethylmercaptan, and amino propylmercaptan.

The amino acid (B5) is appropriately selected depending on the intended purpose without any restriction. Examples thereof include amino propionic acid, and amino caproic acid.

The a blocked compound (B6) where an amino group of any of the foregoing B1 to B5 is blocked is appropriately selected depending on the intended purpose without any restriction.

Examples thereof include a ketimine compound and oxazoline compound obtained from the amines of (B1) to (B5) and ketones (e.g., acetone, methyl ethyl ketone and methyl isobutyl ketone).

—Polyester Resin Containing Functional Group Reactive with Compound Containing Active Hydrogen Group—

The polyester resin containing a functional group reactive with the compound containing an active hydrogen group (may referred to as "polyester prepolymer (A)" hereinafter) is appropriately selected depending on the intended purpose without any restriction, provided that it is a polyester resin containing at least a site reactive with the compound containing an active hydrogen group.

The functional group, which is reactive with the compound containing an active hydrogen group, in the polyester prepolymer (A) is appropriately selected from conventional substituents without any restriction, and examples thereof include an isocyanate group, an epoxy group, a carboxylic acid, and an acid chloride group. These may be contained in the polyester prepolymer (A) singly, or in combination.

Among them, the functional group reactive with the compound containing an active hydrogen group is particularly preferably an isocyanate group.

A method for producing the polyester prepolymer (A) containing the isocyanate group is appropriately selected depending on the intended purpose without any restriction. For example, polyol (A1) and polycarboxylic acid (A2) are heated at 150° C. to 280° C. in the presence of a conventional esterification catalyst such as tetrabutoxy titanate, and dibutyl tin oxide, optionally under reduced pressure, to thereby generate polyester containing a hydroxyl group. Water is then removed from the reaction system to thereby obtain polyester containing a hydroxyl group. Next, the polyester containing a hydroxyl group is allowed to react with polyisocyanate (A3) at 40° C. to 140° C., to thereby yield polyester prepolymer (A) containing an isocyanate group.

The polyol (A1) is appropriately selected depending on the intended purpose without any restriction. Examples thereof include diol, tri or higher polyol, a mixture of diol and tri or higher polyol. These may be used independently, or in combination. Among them, the polyol (A1) is preferably the diol alone, or a mixture of the diol and a small amount of the tri or higher polyol.

The diol is appropriately selected depending on the intended purpose without any restriction. Examples thereof include: alkylene glycol (e.g., ethylene glycol, 1,2-propylene glycol, 1,3-propylene glycol, 1,4-butanediol, and 1,6-hexanediol); alkylene ether glycol (e.g., diethylene glycol, triethylene glycol, dipropylene glycol, polyethylene glycol, polypropylene glycol, and polytetramethylene ether glycol); alicyclic diol (e.g., 1,4-cyclohexanedimethanol, and hydrogenated bisphenol A); bisphenols (e.g., bisphenol A, bisphenol F, and bisphenol S); alkylene oxide (ethylene oxide, propylene oxide, and butylene oxide) adduct of the alicyclic diol; and alkylene oxide (ethylene oxide, propylene oxide, and butylene oxide) adduct of the bisphenols. These may be used independently, or in combination.

Among them, the diol is preferably C2-C12 alkylene glycol, or the alkylene oxide adduct of bisphenols (e.g., bisphenol A ethylene oxide 2 mol adduct, bisphenol A propylene oxide 2 mol adduct, and bisphenol A propylene oxide 3 mol adduct).

The tri or higher polyol is appropriately selected depending on the intended purpose without any restriction. Examples thereof include aliphatic polyhydric alcohol (e.g., glycerin, trimethylol ethane, trimethylol propane, pentaerythritol, and sorbitol); tri or higher polyhydric phenols (e.g. phenol novolak, and cresol novolak); and alkylene oxide adducts of tri or higher polyphenols. These may be used independently, or in combination.

A mixing mass ratio (diol/tri or higher polyol) between the diol and the tri or higher polyol in the mixture of the diol and the tri or higher polyol is appropriately selected depending on the intended purpose without any restriction, but it is preferably 100/0.01 to 100/10, more preferably 100/0.01 to 100/1.

The polycarboxylic acid (A2) is appropriately selected depending on the intended purpose without any restriction. Examples thereof include: alkylene dicarboxylic acid (e.g., succinic acid, adipic acid, and sebacic acid); alkyenylene dicarboxylic acid (e.g., maleic acid, and fumaric acid); and aromatic dicarboxylic acid (e.g., terephthalic acid, isophthalic acid, and naphthalene dicarboxylic acid). These may be used independently, or in combination. Among them, the polycarboxylic acid is preferably C4-C20 alkenylene dicarboxylic acid, or C8-C20 aromatic dicarboxylic acid.

The tri or higher polycarboxylic acid is appropriately selected depending on the intended purpose without any restriction. Examples thereof include C9-C20 aromatic polycarboxylic acid (e.g., trimellitic acid, and pyromellitic acid). These may be used independently, or in combination.

Note that, in place of the polycarboxylic acid, anhydride or lower alkyl ester of the polycarboxylic acid can be used. The lower alkyl ester is appropriately selected depending on the intended purpose without any restriction. Examples thereof include methyl ester, ethyl ester, and isopropyl ester.

The polyisocyanate (A3) is appropriately selected depending on the intended purpose without any restriction. Examples thereof include aliphatic polyisocyanate, alicyclic polyisocyanate, aromatic diisocyanate, aromatic aliphatic diisocyanate, isocyanurates, phenol derivatives of the foregoing polyisocyanates, and the foregoing polyisocyanates blocked with oxime, caprolactam, or the like.

The aliphatic polyisocyanate is appropriately selected depending on the intended purpose without any restriction. Examples thereof include tetramethylene diisocyanate, hexamethylene diisocyanate, 2,6-diisocyanate methyl caproate, octamethylene diisocyanate, decamethylene diisocyanate, dodecamethylene diisocyanate, tetradecamethylene diisocyanate, trimethyl hexane diisocyanate, and tetramethyl hexane diisocyanate.

The alicyclic polyisocyanate is appropriately selected depending on the intended purpose without any restriction. Examples thereof include isophorone diisocyanate, and cyclohexylmethane diisocyanate.

The aromatic diisocyanate is appropriately selected depending on the intended purpose without any restriction. Examples thereof include tolylene diisocyanate, diphenyl methane diisocyanate, 1,5-naphthylenediisocyanate, diphenylene-4,4'-diisocyanate, 4,4'-diisocyanate-3,3'-dimethyldiphenyl, 3-methyldiphenylmethane-4,4'-diisocyanate, and diphenylether-4,4'-diisocyanate.

The aromatic aliphatic diisocyanate is appropriately selected depending on the intended purpose without any restriction. Examples thereof include $\alpha,\alpha,\alpha',\alpha'$-tetramethyl xylylene diisocyanate.

The isocyanurates are appropriately selected depending on the intended purpose without any restriction. Examples thereof include tris-isocyanatealkyl-isocyanurate, and tri-isocyanatecycloalkyl-isocyanurate.

These may be used independently, or in combination.

The average number of isocyanate groups contained in the polyester prepolymer containing an isocyanate group per molecule is appropriately selected depending on the intended purpose without any restriction, but it is preferably 1 or more, more preferably 1.2 to 5, and even more preferably 1.5 to 4.

When the average number of the isocyanate groups is less than 1, the resulting modified polyester resin has a low molecular weight, which may lead to insufficient hot offset resistance, or storage stability of the resulting toner.

The modified polyester resin can be obtained, for example, by reacting the compound containing an active hydrogen (e.g., the amines (B)) with the polyester resin containing a functional group reactive with the compound containing an active hydrogen (e.g., the polyester prepolymer (A)) in an aqueous medium.

If necessary, a solvent may be used at the time of the reaction between the polyester prepolymer (A) and the amines (B).

The solvent for use is appropriately selected depending on the intended purpose without any restriction. Examples thereof include solvents inert to the polyisocyanate (A3), such as an aromatic solvent (e.g., toluene, and xylene), ketones (e.g., acetone, methyl ethyl ketone, methyl isobutyl ketone), esters (e.g., ethyl acetate), amides (e.g., dimethyl formamide, and dimethyl acetamide), and ethers (e.g., tetrahydrofuran). These may be used independently, or in combination.

As for the mixing ratio between the amines (B) and the polyester prepolymer (A) containing an isocyanate group, a mixing equivalent ratio ([NCO]/[NHx]) of the isocyanate group [NCO] contained in the polyester prepolymer containing an isocyanate group to the amino group [NHx] contained in the amines (B) is preferably 1/2 to 2/1, more preferably 1/1.5 to 1.5/1, and even more preferably 1/1.2 to 1.2/1.

When the mixing equivalent ratio ([NCO]/[NHx]) is more than 2/1, or less than ½, the resulting modified polyester resin has a low molecular weight, which may lead to insufficient hot offset resistance of the resulting toner.

In order to terminate the elongation reaction, or crosslink reaction between the compound containing an active hydrogen group and the polyester resin containing a functional group reactive with the compound containing an active hydrogen group, a reaction terminator may be used.

The reaction terminator is appropriately selected depending on the intended purpose without any restriction. Examples thereof include monoamine (e.g., diethyl amine, dibutyl amine, butyl amine, and lauryl amine), and a blocked compound of the foregoing monoamine (e.g., a ketimine compound). These may be used independently, or in combination.

The modified polyester resin may contain a urethane bond as well as the urea bond. A molar ratio (C/D) of the urea bond content (C) to the urethane bond content (D) is appropriately selected depending on the intended purpose without any restriction, but it is preferably 100/0 to 10/90, more preferably 80/20 to 20/80, and even more preferably 60/40 to 30/70. When the urea bond content is smaller than 10/90 in the molar ratio, the resulting toner may have insufficient hot offset resistance.

The weight average molecular weight (Mw) of the modified polyester resin is appropriately selected depending on the intended purpose without any restriction, but it is preferably 10,000 or larger, more preferably 20,000 to 10,000,000, and even more preferably 30,000 to 1,000,000. When the weight average molecular weight (Mw) thereof is smaller than 10,000, the resulting toner may have insufficient hot offset resistance.

The number average molecular weight (Mn) of the modified polyester resin is appropriately selected depending on the intended purpose without any restriction, but it is preferably 20,000 or smaller, more preferably 1,000 to 10,000, and even more preferably 2,000 to 8,000. When the number average molecular weight (Mn) thereof is larger than 20,000, the resulting toner may have insufficient low temperature fixing ability, and insufficient glossiness as used in a full-color image forming apparatus.

The modified polyester resin is preferably used in combination with the unmodified polyester resin. Use of the modified polyester resin in combination with the unmodified polyester resin can improve low temperature fixing ability of the resulting toner, and glossiness of the resulting toner as used in a full-color image forming apparatus.

It is preferred that the modified polyester resin and the unmodified polyester resin be compatible to each other at least in part thereof in view of low temperature fixing ability, and hot offset resistance of the resulting toner.

A mass ratio (A/B) of the modified polyester resin (A) to the unmodified polyester resin (B) is appropriately selected depending on the intended purpose without any restriction, but it is preferably 5/95 to 80/20, more preferably 5/95 to 30/70, even more preferably 5/95 to 25/75, and particularly preferably 7/93 to 20/80. When the amount of the modified polyester resin is smaller than 5/95 in the mass ratio (A/B), the resulting toner may have insufficient hot offset resistance, as well as that it may be difficult to achieve both heat resistance storage stability and low temperature fixing ability of the toner at the same time.

—Other Resins—

Other resins are appropriately selected depending on the intended purpose without any restriction. Examples thereof include a polymer of a monomer, a copolymer of two or more monomers, and a mixture thereof, the monomer(s) including styrene, parachlorostyrene, vinyl toluene, vinyl chloride, vinyl acetate, vinyl propionate, methyl acrylate, methyl methacrylate, ethyl acrylate, ethyl methacrylate, propyl acrylate, propyl methacrylate, n-butyl acrylate, n-butyl methacrylate, isobutyl acrylate, isobutyl methacrylate, dodecyl acrylate, dodecyl methacrylate, 2-ethylhexyl acrylate, 2-ethylhexyl methacrylate, lauryl acrylate, lauryl methacrylate, 2-hydroxyethyl acrylate, 2-hydroxyethyl methacrylate, hydroxypropyl acrylate, hydroxypropyl methacrylate, 2-chloroethyl acrylate, 2-chloroethyl methacrylate, acrylonitrile, methacrylonitrile, acryl amide, methacryl amide, acrylic acid, methacrylic acid, vinyl methyl ether, vinyl ethyl ether, vinyl isobutyl ether, vinyl methyl ketone, N-vinyl pyrrolidone, N-vinyl pyridine, and butadiene. Other examples include a polyol resin, a urethane resin, a polyamide resin, an epoxy resin, rosin, modified rosin, a terpene resin, a phenol resin, and a hydrogenated petroleum resin.

These may be used independently, or in combination.

Furthermore, as other resins, for example, resin particles may be included.

—Resin Particles—

The resin particles are appropriately selected depending on the intended purpose without any restriction. Examples thereof include a vinyl-based resin, a polyurethane resin, an epoxy resin, a polyester resin, a polyamide resin, a polyimide resin, a silicone resin, a phenol resin, a melamine resin, a urea resin, an aniline resin, an iomer resin, and a polycarbonate resin. Among them, the vinyl-based resin, urethane resin, epoxy resin, polyester resin, and a combination thereof are preferable, as it is easy to form an aqueous dispersion of fine spherical resin particles with the foregoing resins, and the vinyl-based resin is more preferable.

The vinyl-based resin is a polymer formed by homopolymerizing or copolymerizing vinyl-based monomers. Examples thereof include a styrene-(meth)acrylic acid ester resin, a styrene-butadiene copolymer, (meth)acrylic acid-acrylic acid ester polymer, a styrene-acrylonitrile copolymer, a styrene-maleic anhydride copolymer, and a styrene-(meth) acrylic acid copolymer. Among them, the styrene-butyl methacrylate copolymer is preferable.

As the resin particles, moreover, a copolymer containing a monomer having at least two unsaturated group may be used.

The monomer having at least two unsaturated groups is appropriately selected depending on the intended purpose without any restriction. Examples thereof include a sodium salt of sulfuric acid ester of methacrylic acid-ethylene oxide adduct (ELEMINOL RS-30, manufactured by Sanyo Chemical Industries, Ltd.), divinyl benzene, and 1,6-hexanediol acrylate.

The weight average molecular weight of the resin particles is appropriately selected depending on the intended purpose without any restriction, but it is preferably 9,000 to 200,000. When the weight average molecular weight thereof is smaller than 9,000, the resulting toner may have insufficient heat resistance storage stability. When the weight average molecular weight thereof is larger than 200,000, the resulting toner may have insufficient low temperature fixing ability.

An amount of the resin particles for use is appropriately selected depending on the intended purpose without any restriction, but it is preferably 0.5% by mass to 5.0% by mass. When the amount thereof is smaller than 0.5% by mass, it may be difficult to control surface hardness and fixing ability of the resulting toner. When the amount thereof is larger than 5.0% by mass, the resin particles inhibit bleeding of the wax, which may cause offset.

The amount of the resin particles can be measured by analyzing the material attributed from the resin particles but not from the toner by thermal decomposition gas chromatograph mass spectrometer, and calculating from its peak area. The detector used here is preferably a mass spectrometer, but not limited.

<Colorant>

The colorant is appropriately selected depending on the intended purpose without any restriction. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant in the toner is appropriately selected depending on the intended purpose without any restriction, but it is preferably 1% by mass to 15% by mass, more preferably 3% by mass to 10% by mass, relative to the toner. When the amount of the colorant is smaller than 1% by mass, the tinting strength may be insufficient. When the amount thereof is larger than 15% by mass, the large amount of the colorant may inhibit the fixation of the resulting toner.

The colorant may be used in the form of a master batch in which the colorant forms a composite with a resin. The resin used for production of the master batch or kneaded together with the master batch includes the modified polyester resin, and non-modified polyester resin mentioned above. Other examples of the resin include: styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes; epoxy resins; epoxy polyol resins; polyurethane resins; polyamide resins; polyvinyl butyrals; polyacrylic acid resins; rosin; modified rosin; terpene resins; aliphatic or alicyclic hydrocarbon resins; aromatic petroleum resins; chlorinated paraffin; and paraffin wax. These may be used independently, or in combination.

The master batch can be prepared by mixing or kneading a colorant with the resin for use in the master batch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, for example, a high-shearing disperser (e.g., a three-roll mill) is preferably used.

<Wax>

The wax is appropriately selected depending on the intended purpose without any restriction. Examples thereof include: polyolefin wax such as polyethylene wax and popypropylene wax; long-chain hydrocarbon such as paraffin wax, and sasol wax; and wax containing a carbonyl group. Among them, the wax containing a carbonyl group is preferable.

These may be used independently, or in combination.

Examples of the wax containing a carbonyl group include polyalkanoic acid esters such as carnauba wax, montan wax, trimethylol propane tribehenate, pentaerythritol tetrabehenate, pentaerythritol diacetate dibehenate, glycerin tribehenate, and 1,18-octadecanediol distearate; polyalkanol esters such as tristearyl trimellitate, and distearyl maleate; polyalkanoic acid amides such as ethylene diamine dibehenyl amide; polyalkyl amide such as trimellitic acid tristearyl amide; and dialkyl ketone such as distearyl ketone. Among them, the polyalkanoic acid ester is preferable.

A melting point of the wax is appropriately selected depending on the intended purpose without any restriction. The melting point thereof is preferably 40° C. to 160° C., more preferably 50° C. to 120° C., and even more preferably. When the melting point thereof is lower than 40° C., the resulting toner may have insufficient heat resistance storage stability. When the melting point thereof is higher than 160° C., the resulting toner may have insufficient low temperature fixing ability.

A melt viscosity of the wax at the temperature higher than the melting point of the wax by 20° C. is appropriately selected depending on the intended purpose without any restriction, but it is preferably 5 mPa·s to 1,000 mPa·s, more preferably 10 mPa·s to 100 mPa·s. When the melt viscosity of the wax at the temperature higher than the melting point of the wax by 20° C. is lower than 5 mPa·s, the resulting toner may have insufficient heat resistance storage stability. When the melt viscosity thereof is higher than 1,000 mPa·s, the resulting toner may have insufficient low temperature fixing ability.

An amount of the wax in the toner is appropriately selected depending on the intended purpose without any restriction, but it is preferably 0.5% by mass to 40% by mass, more preferably 3% by mass to 30% by mass, relative to the toner.

<Other Components>

Other components are appropriately selected depending on the intended purpose without any restriction. Examples thereof include a charge controlling agent, external additives, a flow improving agent, a cleaning improving agent, and a magnetic material.

—Charge Controlling Agent—

The charge controlling agent is appropriately selected depending on the intended purpose without any restriction. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives. Specific examples thereof include BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate), all manufactured by ORIENT CHEMICAL INDUSTRIES CO., LTD; TP-302 and TP-415 (quaternary ammonium salt molybdenum complexes) both manufactured by Hodogaya Chemical Co., Ltd.; LRA-901 and LR-147 (boron complexes), both manufactured by Japan Carlit Co., Ltd.; copper phthalocyanine; perylene; quinacridone; azo pigments; and polymeric compounds having, as a functional group, a sulfonic acid group, carboxyl group, quaternary ammonium salt, etc.

An amount of the charge controlling agent is appropriately selected depending on the intended purpose without any restriction. The amount of the charge controlling agent for use is preferably 0.1 parts by mass to 10 parts by mass, more preferably 0.2 parts by mass to 5 parts by mass, relative to 100 parts by mass of the binder resin. When the amount thereof is smaller than 0.1 parts by mass, the resulting toner may have insufficient charging ability. When the amount thereof is larger than 10 parts by mass, the electrostatic propensity of the resulting toner is excessively large, which may reduce flowability of the toner, or reduce image density of images formed with the resulting toner.

The charge controlling agent may be added by dissolving and dispersing after fusing and kneading together with the master batch and the resin, or added by dissolving or dispersing directly in the organic solvent, or added by fixing on a surface of each toner particle after the preparation of the toner particles.

—External Additives—

The external additives are appropriately selected depending on the intended purpose without any restriction. Examples thereof include silica particles, hydrophobic silica, fatty acid metal salts (e.g., zinc stearate, and aluminum stearate), metal oxides (e.g., titania, alumina, tin oxide, and antimony oxide), and fluoropolymer.

Suitable additives for used include hydrophobic-processed silica particles, titania particles, titanium oxide particles, and alumina particles. Examples of the silica particles include R972, R974, RX200, RY200, R202, R805, and R812 (all manufactured by Nippon Aerosil Co., Ltd.). Examples of the titania particles include: P-25 (manufactured by Nippon Aerosil Co., Ltd.); STT-30, and STT-65C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION).

Examples of the hydrophobic-processed titanium oxide particles include: T-805 (manufactured by Nippon Aerosil Co., Ltd.); STT-30A, and STT-65S-S (both manufactured by Titan Kogyo, Ltd.); TAF-500T, and TAF-1500T (both manufactured by Fuji Titanium Industry Co., Ltd.); MT-100S, and MT-100T (both manufactured by TAYCA CORPORATION); and IT-S (manufactured by ISHIHARA SANGYO KAISHA, LTD.).

The hydrophobic-processed oxide particles, hydrophobic-processed silica particles, hydrophobic-processed titania particles, and hydrophobic-processed alumina particles can be obtained, for example, by processing hydrophobic particles with a silane coupling agent such as methyl trimethoxy silane, methyl triethoxy silane, octyl trimethoxy silane, or the like. Moreover, silicone oil-processed oxide particles and inorganic particles, both of which are obtained by processing inorganic particles with silicone oil, optionally with an application of heat, are also suitably used.

Examples of the silicone oil include dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl-modified silicone oil, methacryl-modified silicone oil, and a-methyl styrene modified silicone oil. Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium oxide are preferable.

An amount of the external additives for use is appropriately selected depending on the intended purpose without any restriction. For example, the amount thereof is preferably 0.1% by mass to 5% by mass, more preferably 0.3% by mass to 3% by mass relative to the toner.

The average primary diameter of the inorganic particles is appropriately selected depending on the intended purpose without any restriction, but it is preferably 100 nm or smaller, more preferably 3 nm to 70 nm. When the average primary diameter of the inorganic particles is smaller than the more preferable range, the inorganic particles are embedded in the toner particles, and may not be able to exhibits the function thereof. When the average primary diameter thereof is larger than the more preferable range, the inorganic particles may unevenly scratch a surface of a photoconductor, and therefore not preferable.

—Flow Improving Agent—

The flow improving agent is appropriately selected depending on the intended purpose without any restriction, provided that it can perform a treatment to improve hydrophobicity so as to prevent the toner from reducing its fluidity and charging properties in high humidity environments. Examples of the flow improving agent include a silane coupling agent, a sililating agent, a silane coupling agent including a fluoroalkyl group, an organic titanate-based coupling agent, silicone oil, and modified silicone oil. The aforementioned silica and titanium oxide are particularly preferably used as hydrophobic silica and hydrophobic titanium oxide, respectively subjected to a surface treatment with the aforementioned flow improving agent.

—Cleaning Improving Agent—

The cleaning improving agent is appropriately selected depending on the intended purpose without any restriction, provided that it is added to the toner in order to remove the residual developer on a photoconductor or a primary transfer member. Examples of the cleaning improving agent include: metal salts of fatty acid such as stearic acid (e.g. zinc stearate, and calcium stearate); and polymer particles produced by soap-free emulsification polymerization (e.g. polymethyl methacrylate particles, and polystyrene particles). The polymer particles preferably have a relatively narrow particle size distribution, preferably having the volume average particle diameter of 0.01 μm to 1 μm.

—Magnetic Material—

The magnetic material is appropriately selected depending on the intended purpose without any restriction. Examples thereof include iron powder, magnetite, and ferrite. Among them, white magnetic materials are preferable in view of the color tone.

<Method for Producing Toner>

The method for producing the toner is appropriately selected depending on the intended purpose without any restriction. Examples thereof include a pulverization method, a polymerization method (e.g. a suspension polymerization method, and an emulsification polymerization method) where a monomer composition containing a certain polymerizable monomer is directly polymerized in an aqueous phase, a method where a certain binder resin solution is emulsified and/or dispersed in an aqueous medium, a method where materials are dissolved in a solvent, followed by removing the solvent, and pulverizing the resultant, and a melt spray method.

—Pulverization Method—

The pulverization method is a method for obtaining the toner, for example, by melt-kneading a toner material, followed by pulverizing and classifying.

For the melt-kneading of the toner material, the toner material (materials for forming a toner) is mixed, and the mixture is placed in a melt-kneader to proceed to melt-kneading. Examples of the melt-kneader include a monoaxial continuous kneader, a biaxial continuous kneader, and a batch-type kneader with a roll mill. Preferable examples thereof include a twin screw extruder KTT manufactured by KOBE STEEL, LTD., an extruder TEM manufactured by TOSHIBA MACHINE CO., LTD., a twin screw extruder, KCK, manufactured by ASADA WORKS CO., LTD., a twin screw extruder PCM manufactured by Ikegai Corp., and a cokneader manufactured by Buss. The melt-kneading is preferably performed under the appropriate conditions so as not to cause scission of molecular chains of the binder resin. Specifically, the temperature of the melt-kneading is adjusted under taking the softening point of the binder resin into consideration. When the temperature of the melt-kneading is very high compared to the softening point, the scission occurs significantly. When the temperature thereof is very low compared to the softening point, the dispersing may not be progressed.

The pulverizing is pulverizing the kneaded product obtained in the melt-kneading. In the pulverizing, it is preferred that the kneaded product be initially pulverized roughly, and then finely pulverized. For the pulverizing, a method in which the kneaded product is pulverized by making the kneaded product to crush into an impact plate in the jet stream, a method in which particles of the kneaded product are made crushed each other in the jet stream to thereby pulverize the kneaded product, or a method in which the kneaded product is pulverized in a narrow cap between a mechanically rotating rotor and a stator is preferably used.

The classifying is classifying the pulverized product obtained by the pulverizing into particles having the predetermined particle diameters. The classifying can be performed by removing the fine particles component by means of a cyclone, a decanter, a centrifugal separator, or the like.

After the completion of the pulverizing and the classifying, the classified pulverized product is classified in an air stream by centrifugal force or the like to thereby produce toner particles having the predetermined particle diameters. The particle diameter of the toner is appropriately selected depending on the intended purpose without any restriction. For example, the particle diameter thereof is in the range of 5 μm to 20 μm.

In the case of the pulverization method, a mechanical impact may be applied to the obtained toner base particles to control the shapes thereof in order to attain the higher average circularity. In this case, the mechanical impact can be applied to the toner base particles, for example, by means of a device such as a hybridizer, and Mechanofusion.

After the classifying, moreover, external additives may be added to the resulting toner particles for enhancing the fluidity, storage stability, developing ability, and transfer ability of the toner.

A method for adding the external additives is, for example, a method using a mixer. Examples of the mixer include a V-type mixer, Rocking Mixer, Loedige Dispersing Mixer, Nauta Mixer, and HENSCHEL MIXER.

Method Where Certain Binder Resin Solution is Emulsified and/or Dispersed in Aqueous Medium—

The method where a certain binder resin solution is emulsified and/or dispersed in an aqueous medium is, for example, a method in which an oil phase containing a toner material is dispersed in an aqueous method for granulation.

The granulation in the aqueous medium is preferably performed, for example, by dissolving and/or dispersing in an organic solvent at least the compound containing an active hydrogen group, the polyester resin containing a functional group reactive with the compound containing an active hydrogen group, the crystalline polyester resin, the unmodified polyester resin, the colorant, and the wax to prepare a solution and/or dispersion; dispersing the solution and/or dispersion in an aqueous medium containing resin particles to prepare a dispersion liquid; allowing the compound containing an active hydrogen group and the polyester resin containing a functional group reactive with the compound containing an active hydrogen group to proceed to a crosslink reaction and/or elongation reaction in the aqueous medium in the presence of the resin particles (the reactant may be referred to as an "adhesive base" hereinafter); and removing the organic solvent from the dispersion liquid. In this method, a preparation of an aqueous medium, a preparation of an oil phase containing a toner material, emulsification and/or dispersion of the toner material, removal of the organic solvent, and the like are performed.

—Preparation of Aqueous Medium (Aqueous Phase)—

The preparation of the aqueous medium can be performed, for example, by dispersing the resin particles in an aqueous medium. An amount of the resin particles added is appropriately selected depending on the intended purpose without any restriction, but it is preferably 0.5% by mass to 10% by mass relative to the aqueous medium.

The aqueous medium is appropriately selected depending on the intended purpose without any restriction. Examples thereof include water, a solvent miscible with water, and a combination of water and the solvent. These may be used independently, or in combination.

Among them, water is preferable.

The solvent miscible with water is appropriately selected depending on the intended purpose without any restriction. Examples thereof include alcohol, dimethylformamide, tetrahydrofuran, cellosolve, and lower ketones. The alcohol is appropriately selected depending on the intended purpose without any restriction. Examples thereof include methanol, isopropanol, and ethylene glycol. The lower ketone is appropriately selected depending on the intended purpose without any restriction. Examples thereof include acetone, and methyl ethyl ketone.

—Preparation of Oil Phase—

The preparation of the oil phase containing the toner material can be performed, for example, by dissolving and/or dispersing in an organic solvent a toner material containing the compound containing an active hydrogen group, the polyester resin containing a functional group reactive with the compound containing an active hydrogen group, the crystalline polyester resin, the unmodified polyester resin, the colorant, and the wax.

The organic solvent is appropriately selected depending on the intended purpose without any restriction, but it is preferably an organic solvent having a boiling point lower than 150° C. as it is easy to be removed.

The organic solvent having a boiling point lower than 150° C. is appropriately selected depending on the intended purpose without any restriction. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used independently, or in combination.

Among them, ethyl acetate, toluene, xylene, benzene, methylene chloride, 1,2-dichloroethane, chloroform, and carbon tetrachloride are preferable, and ethyl acetate is more preferable.

—Emulsification and/or Dispersion—

The emulsification and/or dispersion of the toner material can be performed by dispersing the oil phase containing the toner material in the aqueous medium. At the time when the toner material is emulsified and/or dispersed, an adhesive based is generated by reacting the compound containing an active hydrogen group with the polyester resin containing a functional group reactive with the compound containing an active hydrogen group to proceed to an elongation reaction and/or crosslink reaction.

The adhesive base can be generated, for example, by emulsifying or dispersing in an aqueous medium an oil phase containing the polyester resin reactive with an active hydrogen group, such as polyester prepolymer containing an isocyanate group, together with a compound containing an active hydrogen group, such as amines; and allowing the polyester prepolymer and the amines to react to proceed an elongation reaction and/or crosslink reaction. Alternatively, the adhesive base can be generated by, after emulsifying or dispersing an oil phase containing a toner material in an aqueous medium, adding a compound containing an active hydrogen group thereto, and initiating an elongation reaction and/or crosslink reaction between the polyester prepolymer and the amines at an interface of a particle. In the latter case, the urea-modified polyester is preferentially generated on a surface of a toner base particle to be formed, so that it is possible to give a concentration deviation within the toner particle.

The reaction conditions (e.g. reaction duration and reaction temperature) for generating the adhesive base are not particularly restricted, and are appropriately selected depending on the combination of the compound containing an active hydrogen group, and the polyester resin containing a functional group reactive with the compound containing an active hydrogen group.

The reaction duration is appropriately selected depending on the intended purpose without any restriction, but it is preferably 10 minutes to 40 hours, more preferably 2 hours to 24 hours.

The reaction temperature is appropriately selected depending on the intended purpose without any restriction, but it is preferably 0° C. to 150° C., more preferably 40° C. to 98° C.

A method for stably forming a dispersion liquid containing the polyester resin containing a functional group reactive with the compound containing an active hydrogen group (e.g. polyester prepolymer containing an isocyanate group) in the aqueous medium is appropriately selected depending on the intended purpose without any restriction. Examples of such a method include a method in which an oil phase prepared by dissolving and/or dispersing a toner material in a solvent is added to an aqueous medium, and dispersing the oil phase by shear force.

A disperser used for the dispersing is appropriately selected depending on the intended purpose without any restriction. Examples thereof include a low-speed shearing disperser, a high-speed shearing disperser, a friction disperser, a high-pressure jetting disperser and ultrasonic wave disperser.

Among them, the high-speed shearing disperser is preferable as it enables to control the diameters of the resulting dispersed elements in a range of 2 μm to 20 μm.

In use of the high-speed shearing disperser, the conditions such as the rotating speed, dispersion duration, and dispersion temperature are appropriately selected depending on the intended purpose without any restriction.

The rotating speed is appropriately selected depending on the intended purpose without any restriction, but it is preferably 1,000 rpm to 30,000 rpm, more preferably 5,000 rpm to 20,000 rpm.

The dispersion duration is appropriately selected depending on the intended purpose without any restriction. In the case of a batch system, the duration is preferably 0.1 minutes to 5 minutes.

The dispersion temperature is appropriately selected depending on the intended purpose without any restriction. The dispersion temperature is preferably 0° C. to 150° C., more preferably 40° C. to 98° C. in a pressurized state. Note that, the higher dispersion temperature generally makes dispersion easier.

An amount of the aqueous medium for use at the time when the toner material is emulsified and/or dispersed is appropriately selected depending on the intended purpose without any restriction. The amount thereof is preferably 100 parts by mass to 1,000 parts by mass, relative to 100 parts by mass of the toner material. When the amount of the aqueous medium is smaller than 100 parts by mass, the toner material may not be in a desirable dispersed state, and thus toner base particles of the predetermined particle diameters may not be obtained. When the amount thereof is larger than 1,000 parts by mass, the production cost increases.

It is preferred that a dispersant be used during emulsification and/or dispersion of the oil phase containing the toner material for stabilizing dispersed elements such as oil droplets, forming the dispersed elements into the predetermined shapes, and giving a sharp particle size distribution thereof.

The dispersant is appropriately selected depending on the intended purpose without any restriction. Examples thereof include a surfactant, a poorly water-soluble inorganic dispersant, and a polymer protective colloid. These may be used independently, or in combination.

Among them, the surfactant is preferable.

The surfactant is appropriately selected depending on the intended purpose without any restriction. Examples thereof include an anionic surfactant, a cationic surfactant, a nonionic surfactant, and an amphoteric surfactant.

The anionic surfactant is appropriately selected depending on the intended purpose without any restriction. Examples thereof include alkylbenzenesulfonic acid salts, α-olefin sulfonic acid salts and phosphoric acid esters.

Among them, those containing a fluoroalkyl group are preferable.

A catalyst is optionally used in an elongation reaction and/or crosslink reaction for generating the adhesive base.

The catalyst is appropriately selected depending on the intended purpose without any restriction. Examples thereof include dibutyl tin laurate, and dioctyl tin laurate.

—Removal of Organic Solvent—

A method for removing the organic solvent from the dispersion liquid such as an emulsified slurry is appropriately selected depending on the intended purpose without any restriction. Examples of such a method include: a method where a temperature of an entire system is gradually increased to evaporate the organic solvent contained in the oil droplets; and a method where the dispersion liquid is sprayed in a dry atmosphere to remove the organic solvent in the oil droplets.

Once the organic solvent is removed, toner base particles are formed. The toner base particles can be subjected to washing, drying, and the like, and may be further subjected to classification. The classifying can be performed by removing the fine particles component by means of a cyclone, a decanter, a centrifugal separator, or the like. Alternatively, the classification can be performed after drying the toner base particles.

The obtained toner base particles may be mixed with particles such as the aforementioned external additives, charge controlling agent, and the like. During the mixing, a mechanical impact may be applied so that the particles such as the external additives are prevented from dropping off from the surfaces of the toner base particles.

A method for applying the mechanical impact is appropriately selected depending on the intended purpose without any restriction. Examples thereof include a method in which an impact is applied to a mixture using a high-speed rotating blade, and a method in which an impact is applied by putting mixed particles into a high-speed air flow and accelerating the air speed so that the particles collide against one another or that the particles are crashed into a proper collision plate.

A device used in the aforementioned method is appropriately selected depending on the intended purpose without any restriction. Examples thereof include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar. Developer)

The developer of the present invention contains at least a toner, and may further contain a carrier, and other components, if necessary.

The aforementioned toner used in the developer is the toner of the present invention.

The developer of the present invention may be a one-component developer, or two-component developer.

<Carrier>

The carrier is appropriately selected depending on the intended purpose without any restriction, but it is preferably a carrier containing a core, and a resin layer coating the core.

—Core—

A material of the core is appropriately selected depending on the intended purpose without any restriction, and is preferably, for example, selected from a manganese-strontium (Mn—Sr) based material of 50 emu/g to 90 emu/g, a manganese-magnesium (Mn—Mg) based material of 50 emu/g to 90 emu/g. In order to attain secure a sufficient image density, use of a high magnetic material, such as iron powder (100 emu/g or higher) and magnetite (75 emu/g to 120 emu/g), is preferable. Moreover, a weak magnetic material such as a cupper-zinc (Cu—Zn) based material (30 emu/g to 80 emu/g) is preferable because the resulting carrier enables to reduce the impact of the toner brush onto a photoconductor, and therefore it is advantageous for forming high quality images. These may be used independently, or in combination.

Particle diameters of the core are appropriately selected depending on the intended purpose without any restriction. It is preferred that the core have the average particle diameter (mass average particle diameter (D50)) of 20 μm to 200 μm.

—Resin Layer—

A material of the resin layer is appropriately selected depending on the intended purpose without any restriction. Examples thereof include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer (e.g. a terpolymer of tetrafluoroethylene, vinylidene fluoride, and non-fluoride monomer), and a silicone resin. These may be used independently, or in combination.

Examples of the amino-based resin include a urea-formaldehyde resin, a melamine resin, a benzoguanamine resin, a urea resin, a polyamide resin, and an epoxy resin. Examples of the polyvinyl-based resin include an acryl resin, polymethyl methacrylate, polyacrylonitrile, polyvinyl acetate, polyvinyl alcohol and polyvinyl butyral. Examples of the polystyrene-based resin include polystyrene, and a styrene-acryl copolymer. Examples of the halogenated olefin resin include polyvinyl chloride. Examples of the polyester-based resin include polyethylene terephthalate, and polybutylene terephthalate.

The resin layer may contain conductive powder, if necessary. Examples of the material of the conductive powder include metal, carbon black, titanium oxide, tin oxide and zinc oxide. The average particle diameter of the conductive powder is preferably 1 μm or smaller. When the average particle diameter thereof is larger than 1 μm, it may be difficult to control the electric resistance.

The resin layer can be formed, for example, by preparing a coating liquid by dissolving a silicone resin or the like in a solvent, applying the coating liquid onto the surface of the core by the conventional coating method, drying and baking the coating liquid. Examples of the coating method include dip coating, spray coating, and brush coating.

The solvent is appropriately selected depending on the intended purpose without any restriction. Examples thereof include toluene, xylene, methyl ethyl ketone, methyl isobutyl ketone, cellosolve, and butyl acetate.

The baking method is appropriately selected depending on the intended purpose without any restriction, and is may be of external heating or internal heating.

A device for baking is appropriately selected depending on the intended purpose without any restriction. Examples thereof include a fixed-type electric furnace, a flow-type electric furnace, a rotary electric furnace, a burner furnace, or a device equipped with micro waves.

An amount of the resin layer in the carrier is preferably 0.01% by mass to 5.0% by mass. When the amount of the resin layer is smaller than 0.01% by mass, a uniform resin layer may not be formed on a surface of the core particle. When the amount thereof is greater than 5.0% by mass, a thickness of the resulting resin layer is excessively thick so that the resulting carrier may cause aggregations so that uniform carrier particles may not be obtained.

An amount of the carrier in the developer is appropriately selected depending on the intended purpose without any restriction, but it is preferably 90% by mass to 98% by mass, more preferably 93% by mass to 97% by mass.

A mixing ratio between the toner and carrier in the developer is generally 1 part by mass to 10.0 parts by mass of the toner relative to 100 parts by mass of the carrier.

(Image Forming Apparatus and Image Forming Method)

The image forming apparatus of the present invention contains at least a latent electrostatic image bearing member, a latent electrostatic image forming unit, a developing unit, a transferring unit, and a fixing unit, and may further contain other units, such as a diselectrification unit, a cleaning unit, recycling unit, and a controlling unit, if necessary.

The image forming method of the present invention contains at least a latent electrostatic image forming step, a developing step, a transferring step, and a fixing step, and may further contain other steps, such as a diselectrification step, a cleaning step, a recycling step, and a controlling step, if necessary.

The image forming method of the present invention is suitably performed by the image forming apparatus of the present invention, the latent electrostatic image forming step can be performed by the latent electrostatic image forming unit, the developing step can be performed by the developing unit, the transferring step can be performed by the transferring unit, the fixing step can be performed by the fixing unit, and the aforementioned other steps can be performed by the aforementioned other units.

<Latent Electrostatic Image Forming Step and Latent Electrostatic Image Forming Unit>

The latent electrostatic image forming step is forming a latent electrostatic image on a latent electrostatic image bearing member.

The material, shape, structure, size, and the like of the latent electrostatic image bearing member (may also be referred to as a "photoconductor" or "photoconductor drum" hereinafter) are appropriately selected from those known in the art without any restriction, but the shape thereof is preferably a drum shape.

Examples of the material thereof include e: an inorganic photoconductor such as amorphous silicon, and selenium; and an organic photoconductor such as polysilane, and phthalopolymethine. Among them, the amorphous silicon photoconductor is preferable as it has a long service life.

As for the amorphous silicon photoconductor, for example, a photoconductor having a photoconductive layer formed of a-Si (may also referred to as an "a-Si photoconductor" hereinafter), obtained by heating a substrate to 50° C. to 400° C., followed by forming the photoconductive layer on the substrate by a film forming method such as vacuum deposition, sputtering, ion plating, thermal CVD, photo CVD, and plasma CVD, can be used. Among them, the plasma CVD, i.e., a method where raw material gas is decomposed by DC, or rf or microwave glow discharge, to deposit a-Si film on the substrate, is preferable.

The formation of the latent electrostatic image can be performed, for example, by after charging a surface of the photoconductor, exposing to light imagewise, and can be performed by means of the latent electrostatic image forming unit.

The latent electrostatic image forming unit contains, for example, at least a charging unit configured to charge a surface of the photoconductor, and an exposing unit configured to expose the surface of the photoconductor to light imagewise.

—Charging Unit—

The charging can be performed, for example, by applying voltage to a surface of the photoconductor by means of the charging unit.

The charging unit is appropriately selected depending on the intended purpose without any restriction. Examples thereof include conventional contact chargers known in the art equipped with conductive or semiconductive roller, brush, film, rubber blade, or the like, and conventional non-contact charger using corona discharge such as corotron and scorotron.

The shape of the charger may be any shape such as a magnetic brash, fur brash, and the like, other than the roller, and is appropriately selected depending on the specification, configuration or the like of the image forming apparatus.

In the case where the magnetic brush is used as the charger, the magnetic brush contains various ferrite particles (e.g. Zn—Cu ferrite), which is used as the charger, a non-magnetic conductive sleeve configured to support the ferrite particles, and a magnetic roller disposed inside the sleeve.

In the case where the fur brush is used as the charger, a material of the fur brush is, for example, a conductive-processed fur with carbon, copper sulfide, metal or metal oxide, and the process fur is turned into a charger by winding the fur around a core bar, which is formed of a metal, or is conductive processed in other ways.

The charger is not limited to the contact charger, but the use of the contact charger is preferable as an image forming apparatus a generating amount of ozone of which is reduced is attained.

—Exposing Unit—

The exposing can be performed, for example, by exposing a surface of the photoconductor to light imagewise by means of the exposing unit.

The exposing unit is appropriately selected depending on the intended purpose without any restriction, provided that it can expose the charged surface of the photoconductor by the charging unit to light imagewise corresponding to an image to be formed. Examples thereof include various exposing devices, such as a reproduction optical exposing device, a rod-lens array exposing device, a laser optical exposure device, and a liquid crystal shutter optical device.

A light source used in the exposing unit is appropriately selected depending on the intended purpose without any restriction. Examples thereof include all luminous bodies such as fluorescent lamps, tungsten lamps, halogen lamps, mercury lamps, sodium lamps, light emitting diode (LED), laser diode (LD) (i.e. a semiconductor laser), and electroluminescence (EL).

Moreover, various filters may be used for applying only the light having the predetermined wavelength, and such examples of the filters include a sharp-cut filter, a band-pass filter, a near IR-cut filter, a dichroic filter, an interference filter, and a color conversion filter.

The method of the present invention can also employ a back light system where the imagewise exposing is performed from the back side of the photoconductor.

<Developing Step and Developing Unit>

The developing step is developing the latent electrostatic image with the toner or developer containing the toner to form a visible image.

The aforementioned toner is the toner of the present invention.

The aforementioned developer is the developer of the present invention.

The formation of the visible image can be performed, for example, by developing the latent electrostatic image with the toner or developer containing the toner by means of the developing unit.

The developing unit is not particularly restricted, and can be appropriately selected from the conventional developing units, as long as it is capable of performing development using the toner or developer containing the toner. For example, a developing having at least a developing device housing the toner or developer containing the toner, and capable of applying the toner or developer containing the toner to the latent electrostatic image in a contact or non-contact manner is preferably used.

The developing device may be employ a dry developing system, or wet developing system, and may be a developing device for a singly color, or a developing device for a multi-color. Preferable examples of the developing device include a device having a stirrer configured to charge the toner or developer by frictions from stirring, and a rotatable magnetic roller.

In the developing device, for example, the toner and the carrier are mixed and stirred, and the toner is charged by the friction from the stirring. The charged toner is held on the surface of the rotatable magnetic roller in the form of a brush to form a magnetic brush. The magnetic roller is provided adjacent to the latent electrostatic image bearing member, part of the toner forming the magnetic brush on the surface of the magnetic roller is moved to the surface of the latent electrostatic image bearing member by electrical attraction force. As a result, the latent electrostatic image is developer with the toner to form a visible image on the surface of the latent electrostatic image bearing member.

<Transferring Step and Transferring Unit>

The transferring step is transferring the visible image to a recording medium. In the preferred embodiment, the transferring step uses an intermediate transfer member, and includes primary transferring the visible image onto the intermediate transfer member, and secondary transferring the visible image onto a recording medium.

The transferring can be performed, for example, by charging the latent electrostatic image bearing member, on which the visible image has been formed, by means of a transfer charging device, and this can be performed by the transferring unit. The transferring unit preferably contains a primary transferring unit configured to transfer the visible image onto an intermediate transfer member to form a composite transfer image, and a secondary transferring unit configured to transfer the composite transfer image onto a recording medium.

In the case where the image secondary transferred to the recording medium is a color image formed of a plurality of colors of the toners, the toner of each color is successively superimposed on the intermediate transfer member by the transferring unit to form an image on the intermediate transfer member, and the image formed on the intermediate transfer member is transferred to a recording medium at once by the intermediate transferring unit.

Note that, the intermediate transfer member is appropriately selected from conventional transfer members depending on the intended purpose without any restriction, but it is preferably a transfer belt.

The transferring unit (the primary transferring unit, the secondary transferring unit) preferably contains at least a transfer device configured to charge the visible image formed on the latent electrostatic image bearing member (e.g. the photoconductor) to release the visible image from the photoconductor to the side of the recording medium. The number of the transfer devices equipped may be 1, or 2 or more.

Examples of the transfer device include a corona transfer device utilizing corona discharge, a transfer belt, a transfer roller, a pressure transfer roller, and an adhesion transfer member.

The recording medium is typically plain paper, but it is appropriately selected depending on the intended purpose without any restriction, provided that an unfixed image after the developing can be transferred thereto. Examples thereof include a PET base for OHP.

<Fixing Step and Fixing Unit>

The fixing step is fixing the transferred visible image onto the recording medium. In this step, fixing may be performed every time when an image formed of the toner of each color is transferred onto the recording medium. Alternatively, fixing may be performed after the toners of all the colors are transferred to the recording medium in a laminated state.

The fixing step can be performed by the fixing unit.

The fixing unit is appropriately selected depending on the intended purpose without any restriction, but it is preferably selected from conventional heating and pressurizing member.

Examples of the heating and pressurizing member include a combination of a heating roller and a pressure roller, and a combination of a heating roller, a pressure roller, and an endless belt.

The heating by the heating and pressurizing member is generally performed generally at 80° C. to 200° C.

In the present invention, together with or in place of the fixing unit, for example, a conventional photofixing unit may be used depending on the intended purpose.

<Diselectrification Step and Diselectrification Unit>

The diselectrification step is applying diselectrification bias to the photoconductor to diselectrify the photoconductor, and the diselectrification step can be suitably performed by a diselectrification unit.

The diselectrification unit is appropriately selected from conventional diselectrification units known in the art without any restriction, provided that it is capable of applying diselectrification bias to the photoconductor. The diselectrification unit is preferably a diselectrification lamp.

<Cleaning Step and Cleaning Unit>

The cleaning step is removing the residual toner on the photoconductor, and the cleaning step can be suitably performed by a cleaning unit. Note that, it is also possible to use a method where the residual toner is charged to have the same polarity by a friction member and then collected by a developing roller, without using the cleaning unit.

The cleaning unit is appropriately selected from cleaners known in the art without any restriction, provided that it is capable of removing the toner remained on the photoconductor. Preferable examples thereof include a magnetic brush cleaner, an electrostatic brush cleaner, a magnetic roller cleaner, a blade cleaner, a brush cleaner, and a web cleaner.

<Recycling Step and Recycling Unit>

The recycling step is recycling the toner removed in the cleaning step to the developing unit, and the recycling can be suitably performed by a recycling unit. The recycling unit is not particularly restricted, and examples thereof include conventional conveying units.

<Controlling Step and Controlling Unit>

The controlling step is controlling operations of each step, and can be suitably performed by a controlling unit.

The controlling unit is appropriately selected depending on the intended purpose without any restriction, provided that it is capable of controlling the operations of each step. Examples thereof include devices such as a sequencer, and a computer.

The image forming apparatus is preferably an image forming apparatus containing a process cartridge in which the latent electrostatic image bearing member and at least the developing unit are integratedly supported, where the process cartridge is detachably mounted to the image forming apparatus.

The image forming apparatus of the present invention will be specifically explained with reference to drawings hereinafter, but the image forming apparatus of the present invention shall not be construed as to limit to the following examples accompanied with the drawings.

Next, one embodiment for carrying out a method for forming an image by the image forming apparatus of the present invention is explained with reference to FIG. 2. A color image forming apparatus 100 illustrated in FIG. 2 is equipped with a photoconductor drum 10 (may be also referred to as "photoconductor 10" hereinafter) serving as the latent electrostatic image bearing member, a charging roller 20 serving as the charging unit, an exposing device 30 serving as the exposing unit, a developing device 40 serving as the developing unit, an intermediate transfer member 50, a cleaning device 60 serving as the cleaning unit having a cleaning blade, and an diselectrification lamp 70 serving as the diselectrification unit.

The intermediate transfer member 50 is an endless belt, and is designed to rotate in the direction indicated with an arrow by three rollers 51 disposed inside the intermediate transfer member 50 to support the intermediate transfer member 50. Part of the three rollers 51 also functions as a transfer bias roller capable of applying a predetermined transfer bias (primary transfer bias) to the intermediate transfer member 50. In the surrounding area of the intermediate transfer member 50, the cleaning device 90 having a cleaning blade is provided, and the transfer roller 80 serving as the transferring unit capable of applying a transfer bias for transferring (secondary transferring) a developed image (i.e. the toner image) to the transfer paper 95 serving as a final recording medium is provided to face the intermediate transfer member 50. In the surrounding area of the intermediate transfer member 50, the corona charger 58, which is configured to apply a charge to the toner image on the intermediate transfer member 50, is provided in the area situated between the contact area of the photoconductor 10 and the intermediate transfer member 50, and the contact area of the intermediate transfer member 50 and the transfer paper 95, in the rotation direction of the intermediate transfer member 50.

The developing device 40 consists of a developing belt 41 serving as the developer bearing member, and a black developing unit 45K, a yellow developing unit 45Y, a magenta developing unit 45M, and a cyan developing unit 45C, which are provided next to the developing belt 41. The black developing unit 45K is equipped with a developer-retention section 42K, a developer supply roller 43K, and a developing roller 44K, the yellow developing unit 45Y is equipped with a developer-retention section 42Y, a developer supply roller 43Y, and a developing roller 44Y, the magenta developing unit 45M is equipped with a developer-retention section 42M, a developer supply roller 43M, and a developing roller 44M, and the cyan developing unit 45C is equipped with a developer-retention section 42C, a developer supply roller 43C, and a developing roller 44C. Moreover, the developing belt 41 is an endless belt, which is rotatably supported by a plurality of belt rollers, and at part of which is in contact with the photoconductor 10.

Figure 2:
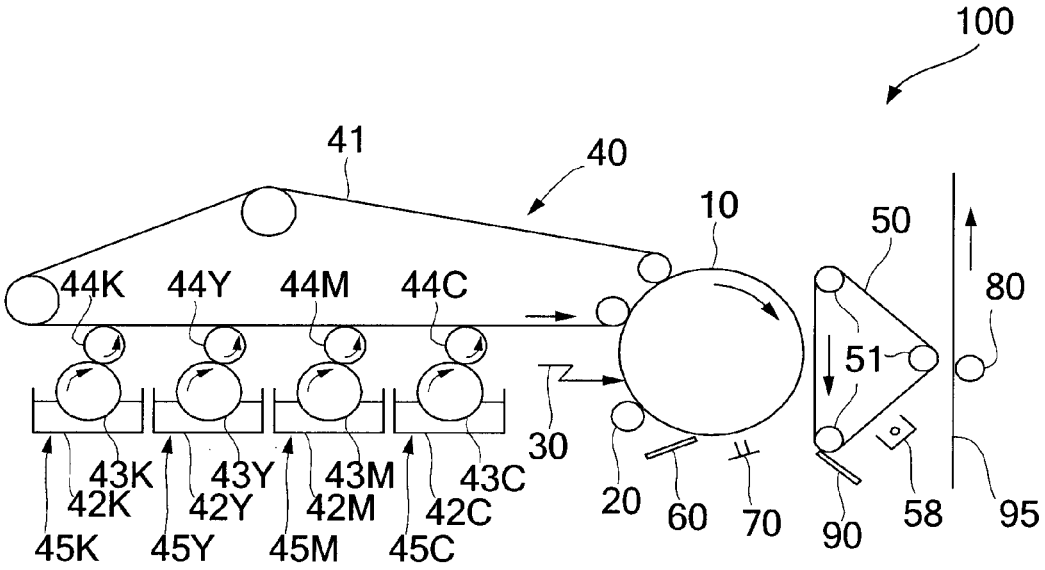
FIG. 2 is a schematic diagram illustrating one example of the image forming apparatus of the present invention.

In the color image forming apparatus 100 illustrated in FIG. 2, for example, the charging roller 20 uniformly charges the photoconductor drum 10. The exposing device 30 applies light onto the photoconductor drum 10 imagewise to perform exposure to thereby form a latent electrostatic image thereon. The latent electrostatic image formed on the photoconductor drum 10 is developed with a toner supplied from the developing device 40 to thereby form a toner image. The toner image is transferred (primary transferred) onto the intermediate transfer member 50 by the voltage applied by the roller 51, and is then transferred (secondary transferred) onto the transfer paper 95. As a result, a transfer image is formed on the transfer paper 95. Note that, the residual toner on the photoconductor 10 is removed by the cleaning device 60, and the charge of the photoconductor 10 is temporarily removed by the diselectrification lamp 70.

Figure 3:
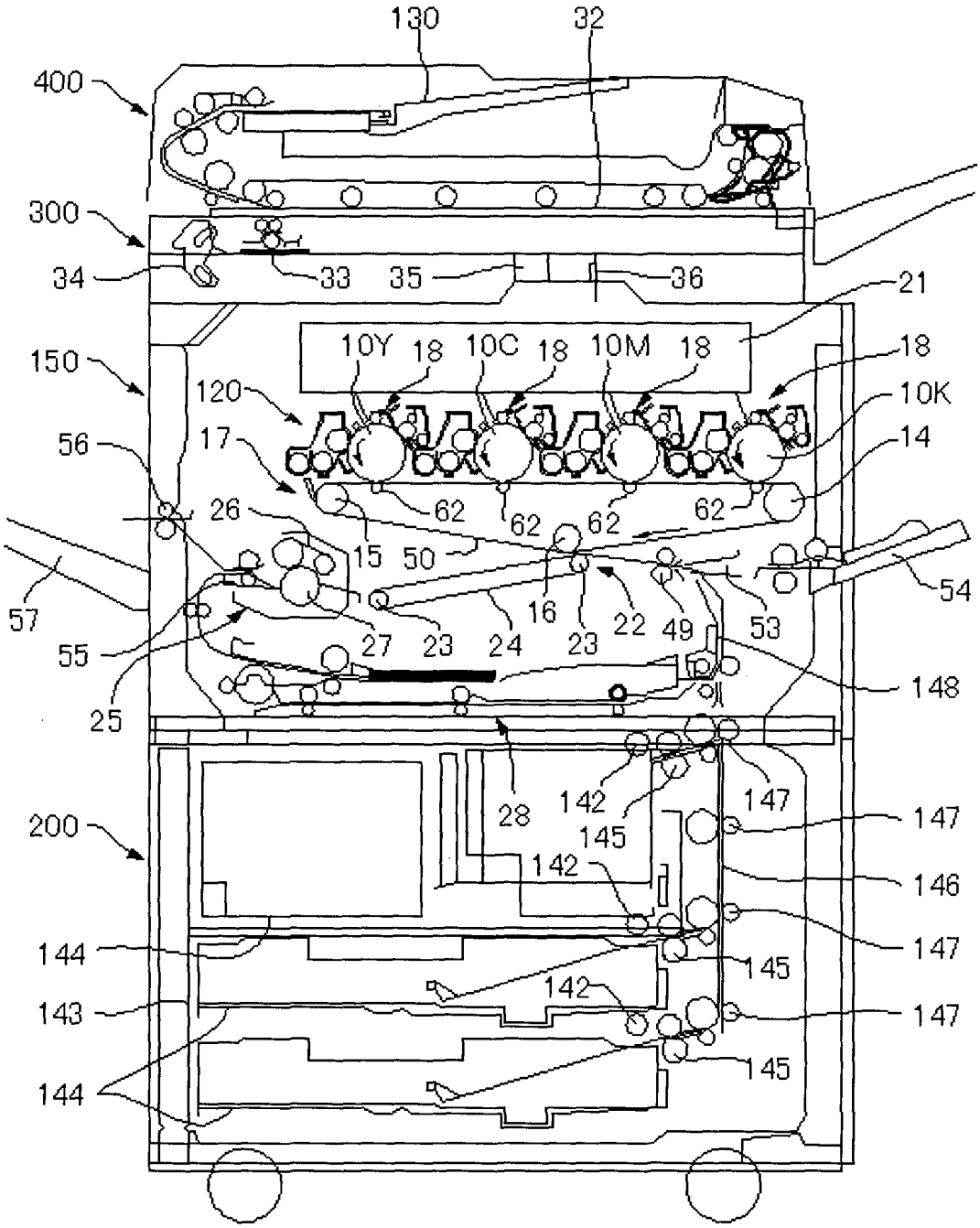
FIG. 3 is a schematic diagram illustrating another example of the image forming apparatus of the present invention.

The color image forming apparatus illustrated in FIG. 3 is equipped with an apparatus main body 150, a feeding table 200, a scanner 300, and an automatic document feeder (ADF) 400.

In the central part of the apparatus main body 150, an intermediate transfer member 50 in the form of an endless belt is provided. The intermediate transfer member 50 is rotatably supported by support rollers 14, 15, and 16 in the clockwise direction in FIG. 3. In the surrounding area of the support roller 15, an intermediate transfer member cleaning device 17 configured to remove the residual toner on the intermediate transfer member 50 is provided. To the intermediate transfer member 50 supported by the support roller 14 and the support roller 15, a tandem developing device 120, in which four image forming units 18, i.e. yellow, cyan, magenta, and black image forming units, are aligned along the traveling direction of the intermediate transfer member 50, is provided. In the surrounding area of the tandem developing device 120, an exposing device 21 is provided. A secondary transfer device 22 is provided at the opposite side of the intermediate transfer member 50 to the side where the tandem developing device 120 is provided. In the secondary transfer device 22, a secondary transfer belt 24, which is an endless belt, is supported by a pair of rollers 23, and is designed so that transfer paper transported on the secondary transfer belt 24 and the intermediate transfer member 50 can be in contact with each other. In the surrounding area of the secondary transfer device 22, a fixing device 25 is provided. The fixing device 25 is equipped with a fixing belt 26, which is an endless belt, and a pressure roller 27 disposed so as to press against the fixing belt 26.

In the tandem image forming apparatus, a sheet reverser 28, which is configured to reverse the transfer paper to perform image formation on both sides of the transfer paper, is provided in the surrounding area of the secondary transfer device 22 and the fixing device 25.

A method for forming a full-color image (i.e., color copying) using the tandem developing device 120 will be explained next. At first, a document is set on a document table 130 of the automatic document feeder (ADF) 400. Alternatively, the automatic document feeder (ADF) 400 is opened, a document is set on a contact glass 32 of the scanner 300, and then the ADF 400 is closed.

In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from a light source of the first carriage 33 is reflected on the surface of the document, the reflected light from the document is further reflected by a mirror of the second carriage 34, and passed through an image formation lens 35, which is then received by a read sensor 36. In this manner, the color document (color image) is read, and image information of black, yellow, magenta, and cyan is obtained.

Figure 4:
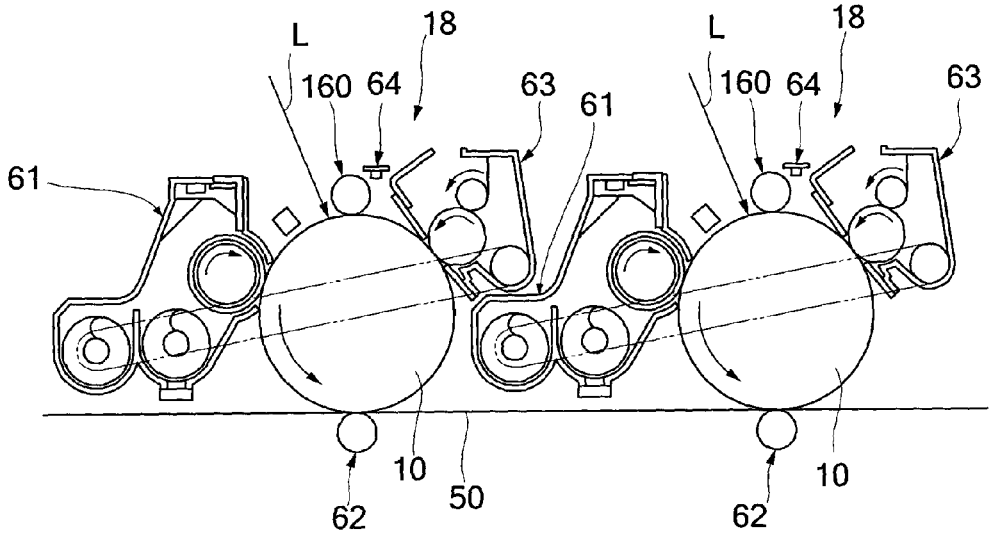
FIG. 4 is a partial enlarged view of FIG. 3.

The image information of each color, black, yellow, magenta or cyan, is transmitted to respective image forming unit 18 (a black image forming unit, a yellow image forming unit, a magenta image forming unit, and a cyan image forming unit) of the tandem developing device 120, and by each image forming unit, a respective toner image, i.e. of black, yellow, magenta, or cyan, is formed. Specifically, each image forming unit 18 (the black image forming unit, the yellow image forming unit, the magenta image forming unit, or the cyan image forming unit) of the tandem developing device 120 is, as illustrated in FIG. 4, equipped with a photoconductor 10 (a black photoconductor 10K, a yellow photoconductor 10Y, a magenta photoconductor 10M, or a cyan photoconductor 10C), a charging device 160 configured to uniformly charge the photoconductor 10, an exposing device configured to expose the photoconductor 10 with light (L, illustrated in FIG. 4) imagewise corresponding to each color image based on the image information of each color to form a latent electrostatic image corresponding to the image of each color on the photoconductor 10, a developing device 61 configured to develop the latent electrostatic image with a respective color toner (a black toner, a yellow toner, a magenta toner, or a cyan toner) to form a toner image of each color toner, a transfer charger 62 configured to transfer the toner image onto an intermediate transfer member 50, a photoconductor cleaning device 63, and diselectrification unit 64. The image forming units can form single color images of respective color (a black image, a yellow image, a magenta image, and a cyan image) corresponding to the respective image information of respective color. The black image, yellow image, magenta image, and cyan image formed in this manner are transferred to the intermediate transfer member 50 rotatably supported by the support rollers 14, 15, and 16 in the following manner. Specifically, the black image formed on the black photoconductor 10K, the yellow image formed on the yellow photoconductor 10Y, the magenta image formed on the magenta photoconductor 10M, and the cyan image formed on the cyan photoconductor 10C are successively transferred (primary transferred) onto the intermediate transfer member 50. On the intermediate transfer member 50, the black image, the yellow image, the magenta image, and the cyan image are superimposed to form a composite color image (a color transfer image).

In the feeding table 200, one of the feeding rollers 142 is selectively rotated to eject a sheet (recording paper) from one of multiple feeder cassettes 144 of a paper bank 143, the ejected sheets are separated one by one by a separation roller 145 to send to a feeder path 146, and then transported by a transport roller 147 into a feeder path 148 within the apparatus main body 150. The sheet transported in the feeder path 148 is then bumped against a registration roller 49 to stop. Alternatively, sheets (recording paper) on a manual-feeding tray 54 are ejected by rotating a feeding roller 142, separated one by one by a separation roller 145 to guide into a manual feeder path 53, and then bumped against the registration roller 49 to stop. Note that, the registration roller 49 is generally earthed at the time of the use, but it may be biased for removing paper dust of the recording paper. Next, the registration roller 49 is rotated synchronously with the movement of the composite color image (color transfer image) superimposed on the intermediate transfer member 50, to thereby send the sheet (recording paper) between the intermediate transfer member 50 and the secondary transfer device 22. The composite color image (color transfer image) is then transferred (secondary transferred) to the sheet (recording paper) by a secondary transfer device 22, to thereby form the color image on the sheet (recording paper). Note that, after transferring the image, the residual toner on the intermediate transfer member 50 is cleaned by the intermediate transfer member cleaning device 17.

The sheet (recording paper) on which the color image has been transferred is transported by a secondary transfer device 22 to send to a fixing device 25. In the fixing device 25, the composite color image (color transfer image) is fixed to the sheet (recording paper) by heat and pressure. Thereafter, the sheet (recording paper) is changed its traveling direction by a switch craw 55, ejected by an ejecting roller 56, and then stacked on an output tray 57. Alternatively, the sheet (recording paper) is changed its traveling direction by the switch craw 55, reversed by the sheet reverser 28 to send to a transfer position, to thereby record an image on the back side thereof. Then, the sheet (recording paper) is ejected by the ejecting roller 56, and stacked on the output tray 57.

EXAMPLES

Examples of the present invention will be explained next, but the following examples shall not be construed as to limit the scope of the present invention in any way. Note that, "part(s)" described in the following examples denotes "part(s) by mass."

In Production Examples, an endothermic peak of the crystalline polyester resin was measured by a differential scanning calorimeter Q200 (of TA Instruments Japan Inc.). Glass transition temperatures of the unmodified polyester resin and the non-crystalline polyester resin were measured also by a differential scanning calorimeter Q200 (of TA Instruments Japan Inc.). The chloroform insoluble component of the unmodified polyester resin was measured by the method described earlier.

In Examples, the volume average particle diameter (Dv) and number average particle diameter (Dp) of the toner were measured by Multisizer III (manufactured by Beckman Coulter, Inc.).

Production Example 1

Synthesis of Crystalline Polyester Resin 1

A 5 L-four necked flask equipped with a nitrogen introducing pipe, a condenser, a stirrer, and a thermocouple was charged with 1,145 g of 1,8-octanedioic acid, 1,120 g of 1,8-octanediol, and 4.9 g of hydroquinone, and the mixture was allowed to react for 10 hours at 180° C., followed by being reacted for 3 hours at 200° C. Then, the resultant was further reacted for 2 hours at 8.3 kPa, to thereby yield Crystalline Polyester Resin 1.

The endothermic peak of Crystalline Polyester Resin 1 was 63° C.

Production Example 2

Synthesis of Crystalline Polyester Resin 2

A 5 L-four necked flask equipped with a nitrogen introducing pipe, a condenser, a stirrer, and a thermocouple was charged with 1,145 g of 1,10-decanedioic acid, 1,120 g of 1,8-octanediol, and 4.9 g of hydroquinone, and the mixture was allowed to react for 10 hours at 180° C., followed by being reacted for 3 hours at 200° C. Then, the resultant was further reacted for 2 hours at 8.3 kPa, to thereby yield Crystalline Polyester Resin 2.

The endothermic peak of Crystalline Polyester Resin 2 was 68° C.

Production Example 3

Synthesis of Crystalline Polyester Resin 3

A 5 L-four necked flask equipped with a nitrogen introducing pipe, a condenser, a stirrer, and a thermocouple was charged with 1,200 g of terephthalic acid, 1,000 g of 1,6-hexanediol, and 4.9 g of hydroquinone, and the mixture was allowed to react for 10 hours at 180° C., followed by being reacted for 3 hours at 200° C. Then, the resultant was further reacted for 2 hours at 8.3 kPa, to thereby yield Crystalline Polyester Resin 3.

The endothermic peak of Crystalline Polyester Resin 3 was 115° C.

Production Example 4

Preparation of Crystalline Polyester Resin Dispersion Liquid 1

A 2 L-metal vessel was charged with 100 g of Crystalline Polyester Resin 1, and 400 g of ethyl acetate, and the mixture was heated to 75° C. to dissolve Crystalline Polyester Resin 1 therein. Then, the resultant was quenched in an iced water bath at the rate of 27° C./min. To the resultant, 500 mL of glass beads (the diameter of 3 mm) were added, and subjected to pulverization by means of a batch type sand mill (manufactured by Kanpe Hapio Co., Ltd.) for 10 hours, to thereby obtain Crystalline Polyester Resin Dispersion Liquid 1.

Production Example 5

Preparation of Crystalline Polyester Resin Dispersion Liquid 2

Crystalline Polyester Resin Dispersion Liquid 2 was obtained in the same manner as in Production Example 4, provided that Crystalline Polyester Resin 1 was replaced with Crystalline Polyester Resin 2.

Production Example 6

Preparation of Crystalline Polyester Resin Dispersion Liquid 3

Crystalline Polyester Resin Dispersion Liquid 3 was obtained in the same manner as in Production Example 4, provided that Crystalline Polyester Resin 1 was replaced with Crystalline Polyester Resin 3.

Production Example 7

Synthesis of Unmodified Polyester Resin 1

A reaction vessel equipped with a nitrogen introducing pipe, a condenser, a stirrer, and a thermocouple was charged with 220 parts of bisphenol A ethylene oxide 2 mol adduct, 560 parts of bisphenol A propylene oxide 3 mol adduct, 220 parts of terephthalic acid, 50 parts of adipic acid, and 3 parts of dibutyl tin oxide, and the mixture was reacted for 8 hours at 230° C. under normal pressure, followed by being reacted for 5 hours under the reduced pressure of 10 mmHg to 15 mmHg. To the resultant, 40 parts of trimellitic anhydride was added, and the mixture was reacted for 3 hours at 180° C. under normal pressure, to thereby yield Unmodified Polyester Resin 1. The glass transition temperature of Unmodified Polyester Resin 1 was 60° C., and the chloroform insoluble component content thereof was 0% by mass.

Production Example 8

Synthesis of Unmodified Polyester Resin 2

A reaction vessel equipped with a nitrogen introducing pipe, a condenser, a stirrer, and a thermocouple was charged with 310 parts of bisphenol A ethylene oxide 2 mol adduct, 470 parts of bisphenol A propylene oxide 3 mol adduct, 103 parts of isophthalic acid, 105 parts of terephthalic acid, 46 parts of adipic acid, and 2 parts of dibutyl tin oxide, and the mixture was reacted for 10 hours at 230° C. under normal pressure, followed by being reacted for 5 hours under the reduced pressure of 10 mmHg to 15 mmHg. To the resultant, 30 parts of trimellitic anhydride was added, and the mixture was reacted for 3 hours at 180° C. under normal pressure, to thereby yield Unmodified Polyester Resin 2. The glass transition temperature of Unmodified Polyester Resin 2 was 52° C., and the chloroform insoluble component content thereof was 0% by mass.

Production Example 9

Synthesis of Unmodified Polyester Resin 3

A reaction vessel equipped with a nitrogen introducing pipe, a condenser, a stirrer, and a thermocouple was charged with 290 parts of bisphenol A ethylene oxide 2 mol adduct, 480 parts of bisphenol A propylene oxide 3 mol adduct, 100 parts of isophthalic acid, 108 parts of terephthalic acid, 46 parts of adipic acid, and 2 parts of dibutyl tin oxide, and the mixture was reacted for 10 hours at 230° C. under normal pressure, followed by being reacted for 5 hours under the reduced pressure of 10 mmHg to 15 mmHg. To the resultant, 30 parts of trimellitic anhydride was added, and the mixture was reacted for 3 hours at 180° C. under normal pressure, to thereby yield Unmodified Polyester Resin 3. The glass transition temperature of Unmodified Polyester Resin 3 was 48° C., and the chloroform insoluble component content thereof was 0% by mass.

Production Example 10

Synthesis of Unmodified Polyester Resin 4

A reaction vessel equipped with a nitrogen introducing pipe, a condenser, a stirrer, and a thermocouple was charged with 719 parts of bisphenol A propylene oxide 2 mol adduct, 274 parts of terephthalic acid, 48 parts of adipic acid, and 2 parts of dibutyl tin oxide, and the mixture was reacted for 8 hours at 230° C. under normal pressure, followed by being reacted for 5 hours under the reduced pressure of 10 mmHg to 15 mmHg. To the resultant, 8 parts of trimellitic anhydride was added, and the mixture was reacted for 2 hours at 180° C. under normal pressure, to thereby yield Unmodified Polyester Resin 4. The glass transition temperature of Unmodified Polyester Resin 4 was 66° C., and the chloroform insoluble component content thereof was 0% by mass.

Production Example 11

Synthesis of Unmodified Polyester Resin 5

A reaction vessel equipped with a nitrogen introducing pipe, a condenser, a stirrer, and a thermocouple was charged with 500 parts of bisphenol A propylene oxide 2 mol adduct, 355 parts of bisphenol A ethylene oxide 2 mol adduct, 430 parts of terephthalic acid, 180 parts of dodecenyl succinic anhydride, and 110 parts of trimellitic anhydride, followed by adding 2 parts of dibutyl tin oxide. The mixture was reacted at 200° C. in an inert atmosphere, to thereby yield Unmodified Polyester Resin 5. The glass transition temperature of Unmodified Polyester Resin 5 was 67° C., and the chloroform insoluble component content thereof was 26% by mass.

Production Example 12

Synthesis of Unmodified Polyester Resin 6

A reaction vessel equipped with a nitrogen introducing pipe, a condenser, a stirrer, and a thermocouple was charged with 500 parts of bisphenol A propylene oxide 2 mol adduct, 355 parts of bisphenol A ethylene oxide 2 mol adduct, 600 parts of fumaric acid, and 100 parts of trimellitic anhydride, followed by adding 2 parts of dibutyl tin oxide. The mixture was reacted at 200° C. in an inert atmosphere, to thereby yield Unmodified Polyester Resin 6. The glass transition temperature of Unmodified Polyester Resin 6 was 60° C., and the chloroform insoluble component content thereof was 12% by mass.

Production Example 13

Synthesis of Unmodified Polyester Resin 7

A reaction vessel equipped with a nitrogen introducing pipe, a condenser, a stirrer, and a thermocouple was charged with 500 parts of bisphenol A propylene oxide 2 mol adduct, 355 parts of bisphenol A ethylene oxide 2 mol adduct, 410 parts of terephthalic acid, 150 parts of dodecenyl succinic anhydride, and 140 parts of trimellitic anhydride, followed by adding 2 parts of dibutyl tin oxide. The mixture was reacted at 200° C. in an inert atmosphere, to thereby yield Unmodified Polyester Resin 7. The glass transition temperature of Unmodified Polyester Resin 7 was 62° C., and the chloroform insoluble component content thereof was 31% by mass.

Production Example 14

Synthesis of Non-Crystalline Polyester Resin Dispersion Liquid 1

A reaction vessel equipped with a cooling pipe, a stirrer, and a nitrogen introducing pipe was charged with 724 parts of bisphenol A ethylene oxide 2 mol adduct, 200 parts of isophthalic acid, 70 parts of fumaric acid, and 2 parts of dibutyl tin oxide, and the mixture was allowed to react for 8 hours at 230° C. under normal pressure, followed by being reacted for 5 hours under the reduced pressure of 10 mmHg to 15 mmHg. Then, the resultant was cooled to 160° C. To this, 32 parts of phthalic anhydride was added, and the mixture was reacted for 2 hours, followed by cooling to 80° C. To this, 200 parts of styrene, 1 part of benzoyl peroxide, and 0.5 parts of dimethyl aniline were added, and the mixture was reacted in ethyl acetate for 2 hours, to thereby yield Modified Polyester Resin 1.

Modified Polyester Resin 1 (150 parts) and Unmodified Polyester Resin 1 (850 parts) were dissolved in an ethyl acetate solvent (2,000 parts), followed by mixing, to thereby obtain Non-Crystalline Polyester Resin Dispersion Liquid 1. Part of Non-Crystalline Polyester Resin Dispersion Liquid 1 was dried under reduced pressure, to thereby obtain Non-Crystalline Polyester Resin 1. The glass transition temperature of Non-Crystalline Polyester Resin 1 was 65° C.

Production Example 15

Synthesis of Non-Crystalline Polyester Resin Dispersion Liquid 2

A reaction vessel equipped with a cooling pipe, a stirrer, and a nitrogen introducing pipe was charged with 724 parts of bisphenol A ethylene oxide 2 mol adduct, 276 parts of isophthalic acid, and 2 parts of dibutyl tin oxide, and the mixture was allowed to react for 8 hours at 230° C. under normal pressure, followed by being reacted for 5 hours under the reduced pressure of 10 mmHg to 15 mmHg. Then, the resultant was cooled to 160° C. To this, 32 parts of phthalic anhydride was added, and the mixture was reacted for 2 hours, followed by cooling to 80° C. The resultant was allowed to react with 188 parts of isophorone diisocyanate for 2 hours in ethyl acetate, to thereby yield Prepolymer 1. Prepolymer 1 (267 parts) was allowed to react with isophorone diamine (14 parts) for 2 hours at 50° C., to thereby yield Urea-Modified Polyester Resin 1 having the weight average molecular weight of 64,000.

Urea-Modified Polyester Resin 1 (150 parts) and Unmodified Polyester Resin 2 (850 parts) were dissolved in an ethyl acetate solvent (2,000 parts), followed by mixing, to thereby obtain Non-Crystalline Polyester Resin Dispersion Liquid 2. Part of Non-Crystalline Polyester Resin Dispersion Liquid 2 was dried under reduced pressure, to thereby obtain Non-Crystalline Polyester Resin 2. The glass transition temperature of Non-Crystalline Polyester Resin 2 was 63° C.

Production Example 16

Synthesis of Non-Crystalline Polyester Resin Dispersion Liquid 3

A reaction vessel equipped with a cooling pipe, a stirrer, and a nitrogen introducing pipe was charged with 724 parts of bisphenol A ethylene oxide 2 mol adduct, 200 parts of isophthalic acid, 70 parts of fumaric acid, and 2 parts of dibutyl tin oxide, and the mixture was allowed to react for 8 hours at 230° C. under normal pressure, followed by being reacted for 5 hours under the reduced pressure of 10 mmHg to 15 mmHg. Then, the resultant was cooled to 160° C. To this, 32 parts of phthalic anhydride was added, and the mixture was reacted for 2 hours, followed by cooling to 80° C. To this, 200 parts of styrene, 1 part of benzoyl peroxide, and 0.5 parts of dimethyl aniline were added, and the mixture was reacted in ethyl acetate for 2 hours, to thereby yield Modified Polyester Resin 1.

Modified Polyester Resin 1 (300 parts) and Unmodified Polyester Resin 1 (700 parts) were dissolved in an ethyl acetate solvent (2,000 parts), followed by mixing, to thereby obtain Non-Crystalline Polyester Resin Dispersion Liquid 3. Part of Non-Crystalline Polyester Resin Dispersion Liquid 3 was dried under reduced pressure, to thereby obtain Non-Crystalline Polyester Resin 3. The glass transition temperature of Non-Crystalline Polyester Resin 3 was 69° C.

Production Example 17

Synthesis of Non-Crystalline Polyester Resin Dispersion Liquid 4

A 2 L-metal vessel was charged with 90 g of Unmodified Polyester Resin 1, 10 g of Unmodified Polyester Resin 5 and 400 g of ethyl acetate, and the mixture was heated to 75° C. to dissolve the unmodified polyester resins therein. Then, the resultant was quenched in an iced water bath at the rate of 27° C./min. To the resultant, 500 mL of glass beads (the diameter of 3 mm) were added, and subjected to pulverization by means of a batch type sand mill (manufactured by Kanpe Hapio Co., Ltd.) for 10 hours, to thereby obtain Non-Crystalline Polyester Resin Dispersion Liquid 4. Part of Non-Crystalline Polyester Resin Dispersion Liquid 4 was dried under reduced pressure, to thereby obtain Non-Crystalline Polyester Resin 4. The glass transition temperature of Non-Crystalline Polyester Resin 4 was 62° C.

Production Example 18

Synthesis of Non-Crystalline Polyester Resin Dispersion Liquid 5

A 2 L-metal vessel was charged with 88 g of Unmodified Polyester Resin 1, 12 g of Unmodified Polyester Resin 7 and 400 g of ethyl acetate, and the mixture was heated to 75° C. to dissolve the unmodified polyester resins therein. Then, the resultant was quenched in an iced water bath at the rate of 27° C./min. To the resultant, 500 mL of glass beads (the diameter of 3 mm) were added, and subjected to pulverization by means of a batch type sand mill (manufactured by Kanpe Hapio Co., Ltd.) for 10 hours, to thereby obtain Non-Crystalline Polyester Resin Dispersion Liquid 5. Part of Non-Crystalline Polyester Resin Dispersion Liquid 5 was dried under reduced pressure, to thereby obtain Non-Crystalline Polyester Resin 5. The glass transition temperature of Non-Crystalline Polyester Resin 5 was 60° C.

Production Example 19

Synthesis of Non-Crystalline Polyester Resin Dispersion Liquid 6

A 2 L-metal vessel was charged with 90 g of Unmodified Polyester Resin 4, 10 g of Unmodified Polyester Resin 7 and 400 g of ethyl acetate, and the mixture was heated to 75° C. to dissolve the unmodified polyester resins therein. Then, the resultant was quenched in an iced water bath at the rate of 27° C./min. To the resultant, 500 mL of glass beads (the diameter of 3 mm) were added, and subjected to pulverization by means of a batch type sand mill (manufactured by Kanpe Hapio Co., Ltd.) for 10 hours, to thereby obtain Non-Crystalline Polyester Resin Dispersion Liquid 6. Part of Non-Crystalline Polyester Resin Dispersion Liquid 6 was dried under reduced pressure, to thereby obtain Non-Crystalline Polyester Resin 6. The glass transition temperature of Non-Crystalline Polyester Resin 6 was 65° C.

Production Example 20

Synthesis of Non-Crystalline Polyester Resin Dispersion Liquid 7

A 2 L-metal vessel was charged with 90 g of Unmodified Polyester Resin 1, 10 g of Unmodified Polyester Resin 6 and 400 g of ethyl acetate, and the mixture was heated to 75° C. to dissolve the unmodified polyester resins therein. Then, the resultant was quenched in an iced water bath at the rate of 27° C./min. To the resultant, 500 mL of glass beads (the diameter of 3 mm) were added, and subjected to pulverization by means of a batch type sand mill (manufactured by Kanpe Hapio Co., Ltd.) for 10 hours, to thereby obtain Non-Crystalline Polyester Resin Dispersion Liquid 7. Part of Non-Crystalline Polyester Resin Dispersion Liquid 7 was dried under reduced pressure, to thereby obtain Non-Crystalline Polyester Resin 7. The glass transition temperature of Non-Crystalline Polyester Resin 7 was 60° C.

Example 1

Production of Toner

A beaker was charged with 500 parts of Non-Crystalline Polyester Resin Dispersion Liquid 1, 70 parts of Crystalline Polyester Resin Dispersion Liquid 1, 20 parts of pentaerythritol tetrabehenate (melting point: 81° C., melt viscosity: 25 mPa·s), and 4 parts of carbon black, and the mixture was stirred by TK homomixer at 60° C., and 12,000 rpm, to uniformly dissolve and disperse the materials, to thereby obtain a toner material solution.

A separate beaker was charged with 706 parts of ion-exchanged water, 294 parts of 10% by mass hydroxyapatite suspension (SuperTite 10, manufactured by Nippon Chemical Industrial Co., Ltd.), and 0.2 parts of sodium dodecyl benzene sulfonate, and the mixture was homogenously dissolved. Then, the mixture was heated to 60° C., and the above-obtained toner material solution was added thereto with stirring by TK homomixer at 12,000 rpm, followed by stirring for 10 minutes. Next, the resulting mixed solution was poured into a flask equipped with a stirring rod and a thermometer, and heated to 98° C. to remove the solvent, followed by being subjected to filtration, washing, drying, and air classification, to thereby obtain toner particles.

The obtained toner particles had the volume average particle diameter (Dv) of 6.2 μm, number average particle diameter (Dp) of 5.2 μm, and a ratio Dv/Dp of 1.19.

The toner particles (100 parts) were mixed with hydrophobic silica (0.5 parts) and hydrophobic titanium oxide (0.5 parts) by means of HENSCHEL MIXER, to thereby obtain Toner 1.

<Measurements>

—Measurements of Ta and Tb—

Ta and Tb of the toner were measured by the following method.

For the measurement, a differential scanning calorimeter Q200 (of TA Instruments Japan Inc.) was used as a temperature modulated DSC.

Specifically as the measuring method of the glass transition temperature Ta, the following operations were carried out. At first, about 5.0 mg of the toner was placed in an aluminum sample container. The sample container was placed on a holder unit, and set in an electric furnace. Next, in a nitrogen atmosphere, the sample was heated from 0° C. to 150° C. at a heating rate of 3° C./min, and a modulation cycle of 0.5° C./60 sec, to thereby obtain a DSC curve of a first heating process. Sequentially, the sample was cooled from 150° C. to 0° C. at a cooling rate of 20° C./min, and a modulation cycle of 0.5° C./60 sec, followed by heating from 0° C. to 150° C. at a heating rate of 3° C./min, and modulation cycle of 0.5° C./60 sec, to thereby obtain a DSC curve of a second heating process. A constant heating component was selected from the DSC curve of the second heating process, and glass transition temperature thereof was determined by an analysis program, TA Universal Analysis (of TA Instruments Japan Inc.). In the manner as mentioned, the glass transition temperature Ta was measured.

Specifically as the measuring method of the glass transition temperature Tb, the following operations were performed. At first, about 5.0 mg of the toner was placed in an aluminum sample container. The toner in the sample container was heated to 150° C. by the differential scanning calorimeter at a heating rate of 10° C./min, followed by self-cooled, and left to stand for 1 month at room temperature. Then, the aluminum sample container was set in an electric furnace. Next, in a nitrogen atmosphere, the sample was heated from 0° C. to 150° C. at a heating rate of 3° C./min, and a modulation cycle of 0.5° C./60 sec, to thereby obtain a DSC curve of a first heating process. A constant heating component was selected from the DSC curve of the first heating process, and glass transition temperature thereof was determined by an analysis program, TA Universal Analysis (of TA Instruments Japan Inc.). In the manner as mentioned, the glass transition temperature Tb was measured.

The result was depicted in Table 1.

<Evaluation>

—Low Temperature Fixing Ability—

A copying test was performed by means of a device, in which a fixing section of a copier MF2200 (manufactured by Ricoh Company Limited) was modified to have a Teflon (registered trade mark) roller as a fixing roller, to form a solid image on a sheet of paper Type 6200 (manufactured by Ricoh Company Limited) with a toner deposition amount of 0.8 mg/cm$^2$.

Specifically, a fixing test was performed with changing a fixing temperature to thereby determine a cold offset temperature (lowest fixing temperature).

The evaluation conditions of the lowest fixing temperature included a feeding linear velocity of 150 mm/sec to 200 mm/sec, surface pressure of 1.2 kgf/cm$^2$, and nip-width of 4 mm.

The lowest fixing temperature was evaluated based on the following evaluation criteria. The results are depicted in Table 1.

A: Lower than 130° C.

B: 130° C. or higher but lower than 135° C.

C: 135° C. or higher but lower than 140° C.

D: 140° C. or higher

—Heat Resistance Storage Stability—

The toner was measured and sampled by 10 g, and placed into a 20 mL-glass vessel. After tapping the glass vessel 100 times by a tapping device, the sample in the glass vessel was left in a thermostat set at the temperature of 50° C., and humidity of 80% for 24 hours, and then a penetration degree was measured by a penetration degree tester (manufactured by Nikka Engineering Co., Ltd., with setting conditions described in a manual), and evaluated based on the following evaluation criteria. The results are depicted in Table 1.

A: Penetration degree was 20 mm or more

B: Penetration degree was 15 mm or more but less than 20 mm

C: Penetration degree was 10 mm or more but less than 15 mm

D: Penetration degree was less than 10 mm

—Image Maintainability—

A copying test was performed by means of a device, in which a fixing section of a copier MF2200 (manufactured by Ricoh Company Limited) was modified to have a Teflon (registered trade mark) roller as a fixing roller, to form a solid image on a sheet of paper Type 6200 (manufactured by Ricoh Company Limited) with a toner deposition amount of 0.8 mg/cm$^2$.

The printed sheet on which the image had been fixed was folded in a manner that parts of the imaging part were in contact to each other, and the folded sheet was sandwiched with a pair of slide glass. In this state, the both edges of the slide glass laminate were wound with rubber bands. On the slide glass laminate, a 500 g-weight having a bottom surface area of 3 cm×3 cm was placed, and the slide glass laminate was left in this state for 1 week at 50° C. The maintainability of the image was determined by the state when the contact imaging parts were unfolded after being left in the aforementioned conditions. The results are depicted in Table 1.

A: No sound was made when the imaging parts were peeled, and there was no missing part in the image.

B: Slight dry sound was made when the imaging parts were peeled, but there was no missing part in the image.

C: Dry sound was made when the imaging parts were peeled, and a missing part having a diameter smaller than 0.5 mm, or unevenness was observed in the image.

D: Dry sound was made significantly when the imaging parts were peeled, and a missing part having a diameter of 0.5 mm or larger was observed in the image.

Example 2

Production of Toner

—Synthesis of Prepolymer of Urea-Modified Polyester Resin—

A reaction vessel equipped with a cooling pipe, a stirrer, and a nitrogen introducing pipe was charged with 712 parts of bisphenol A ethylene oxide 2 mol adduct, 81 parts of bisphenol A propylene oxide 2 mol adduct, 285 parts of terephthalic acid, 22 parts of trimellitic anhydride, and 2 parts of dibutyl tin oxide, and the mixture was allowed to react for 8 hours at 230° C. under normal pressure, followed by being reacted for 5 hours under the reduced pressure of 10 mmHg to 15 mmHg, to thereby yield Intermediate Polyester 1. The glass transition temperature of Intermediate Polyester 1 was 57° C.

Next, a reaction vessel equipped with a cooling pipe, a stirrer, and a nitrogen introducing pipe was charged with 410 parts of Intermediate Polyester 1, 89 parts of isophorone diisocyanate, and 500 parts of ethyl acetate, and the mixture was reacted for 5 hours at 100° C., to thereby obtain Prepolymer 2.

—Synthesis of Ketimine Compound—

A reaction vessel equipped with a stirring rod and thermometer was charged with 170 parts of isophorone diamine, and 75 parts of methyl ethyl ketone, and the mixture was reacted for 5 hours at 50° C., to thereby yield Ketimine Compound I. Ketimine Compound I had the amine value of 418.

—Preparation of Master Batch (MB)—

Water (1,200 parts), carbon black (Printex 35, product of Degussa) [DBP oil absorption amount=42 mL/100 mg, pH=9.5] (540 parts), and Unmodified Polyester Resin 2 (1,200 parts) were mixed by HENSCHEL MIXER (product of Mitsui Mining Co., Ltd). The resulting mixture was kneaded for 3 hours at 150° C. with a two-roll mill, and then rolled, cooled and pulverized with a pulverizer, to thereby produce Master Batch 1.

—Preparation of Oil Phase—

A vessel equipped with a stirring rod, and a thermometer was charged with 378 parts of Unmodified Polyester Resin 2, 100 parts of carnauba wax (EMUSTAR-0413, manufactured by Nippon Seiro Co., Ltd.), and 947 parts of ethyl acetate, and the mixture was heated to 80° C. with stirring. The temperature thereof was kept at 80° C. for 5 hours, followed by cooling to 30° C. over 1 hour. Next, to the vessel, 500 parts of Master Batch 1, and 500 parts of ethyl acetate were added, and the resulting mixture was mixed for 1 hour to thereby obtain Raw Material Solution 1.

Raw Material Solution 1 (1,324 parts) was poured into a vessel, and the carbon black and the wax therein were dispersed by means of a bead mill (ULTRA VISCOMILL, manufactured by AIMEX CO., Ltd.) under the following conditions: a liquid feed rate of 1 kg/hr, disc circumferential velocity of 6 m/s, 0.5 mm-zirconium beads packed to 80% by volume, and 3 passes.

To this, 1,042 parts of 65% by mass Unmodified Polyester Resin 2 ethyl acetate solution was added, and the resulting mixture was dispersed with the bead mill under the above conditions once (one pass), to thereby obtain Pigment-Wax Dispersion Liquid 1. Pigment-Wax Dispersion Liquid 1 had a solids content (130° C., 30 minutes) of 50%.

—Synthesis of Organic Particle Emulsion—

A reaction vessel equipped with a stirring rod and thermometer was charged with 683 parts of water, 11 parts of a sodium salt of sulfuric acid ester of methacrylic acid-ethylene oxide adduct (ELEMINOL RS-30, manufactured by Sanyo Chemical Industries, Ltd.), 83 parts of styrene, 83 parts of methacrylic acid, 110 parts of butyl acrylate, and 1 part of ammonium persulfate, and the resulting mixture was stirred for 15 minutes at 400 rpm to thereby obtain a white emulsion. The obtained emulsion was heated until the internal system temperature reached 75° C., and then was allowed to react for 5 hours. Subsequently, a 1% by mass aqueous ammonium persulfate solution (30 parts by mass) was added to the reaction mixture, followed by aging for 5 hours at 75° C., to thereby prepare an aqueous dispersion liquid (Particle Dispersion Liquid 1) of a vinyl-based resin (a copolymer of styrene/methacrylic acid/sodium salt of sulfuric acid ester of methacrylic acid ethylene oxide adduct).

Particle Dispersion Liquid 1 was measured by LA-920 (manufactured by Horiba, Ltd.), and as a result, the volume average particle diameter thereof was 0.14 μm. Part of Particle dispersion Liquid 1 was dried to isolate a resin component.

—Preparation of Aqueous Phase—

Water (990 parts), 83 parts of Particle Dispersion Liquid 1, 37 parts of a 48.3% by mass sodium dodecyldiphenyl ether disulfonate aqueous solution (ELEMINOL MON-7, product of Sanyo Chemical Industries Ltd.) and 90 parts of ethyl acetate were mixed together and stirred to obtain an opaque white liquid, which was used as Aqueous Phase 1.

—Emulsification and Removal of Solvent—

A vessel was charged with 680 parts of Pigment-Wax Dispersion Liquid 1, 109.4 parts of Prepolymer 2, 73.9 parts of Crystalline Polyester Resin Dispersion Liquid 1, and 4.6 parts of Ketimine Compound I, and the mixture was mixed for 1 minute at 5,000 rpm with a TK homomixer (manufactured by Tokushu Kika Kogyo Co., Ltd.). To the resultant in the vessel, 1,200 parts of Aqueous Phase 1 was added, and the resulting mixture was mixed for 25 minutes at 13,000 rpm to thereby obtain Emulsified Slurry 1.

A vessel equipped with a stirrer and a thermometer was charged with Emulsified Slurry 1, and the solvent was removed from Emulsified Slurry 1 for 8 hours at 30° C., followed by subjecting Emulsified Slurry 1 to aging for 4 hours at 45° C., to thereby obtain Dispersion Slurry 1.

—Washing and Drying—

After filtering the obtained Dispersion Slurry 1 (100 parts) under the reduced pressure, the following operations were performed.

(1): ion-exchanged water (100 parts) was added to the filtration cake, and the mixture was mixed with a TK homomixer (at 12,000 rpm for 10 minutes), followed by filtration;

(2): a 10% aqueous sodium hydroxide solution (100 parts) was added to the filtration cake obtained in (1), and the mixture was mixed with a TK homomixer (at 12,000 rpm for 30 minutes) followed by filtration under reduced pressure;

(3): 10% hydrochloric acid (100 parts) was added to the filtration cake obtained in (2), and the mixture was mixed with a TK homomixer (at 12,000 rpm for 10 minutes) followed by filtration; and (4): ion-exchanged water (300 parts) was added to the filtration cake obtained in (3), and the mixture was mixed with a TK homomixer (at 12,000 rpm for 10 minutes), followed by filtration, and this operation was performed twice, to thereby produce Filtration Cake 1.

Filtration Cake 1 was dried with an air-circulating drier for 48 hours at 45° C., and was then passed through a sieve with a mesh size of 75 μm, to thereby prepare Toner Base Particles 1.

Then, 100 parts of Toner Base Particles 1, 0.7 parts of hydrophobic-processed silica having a particle diameter of 13 μm, and 0.3 parts of hydrophobic titanium oxide were mixed by HENSCHEL MIXER, to thereby obtain Toner 2.

The obtained toner was evaluated in the same manner as in Example 1. The results are depicted in Table 1.

Example 3

Toner 3 was obtained in the same manner as in Example 2, provided that Unmodified Polyester Resin 2 was replaced with Unmodified Polyester Resin 3, and Crystalline Polyester Resin Dispersion Liquid 1 was replaced with Crystalline Polyester Resin Dispersion Liquid 2, and in the emulsifying process, the amounts of Pigment-Wax Dispersion Liquid, Prepolymer 2, and Crystalline Polyester Resin Dispersion Liquid 2 were changed to 677 parts, 112 parts, and 75 parts, respectively.

The obtained toner was evaluated in the same manner as in Example 1. The results are depicted in Table 1.

Example 4

Toner 4 was obtained in the same manner as in Example 1, provided that Non-Crystalline Polyester Resin Dispersion Liquid 1 was replaced with Non-Crystalline Polyester Resin Dispersion Liquid 2, Crystalline Polyester Resin Dispersion Liquid 1 was replaced with Crystalline Polyester Resin Dispersion Liquid 2, and the amount of Crystalline Polyester Resin Dispersion Liquid 2 was changed to 90 parts.

The obtained toner was evaluated in the same manner as in Example 1. The results are depicted in Table 1.

Example 5

Toner 5 was obtained in the same manner as in Example 2, provided that Unmodified Polyester Resin 2 was replaced with Unmodified Polyester Resin 1, and Crystalline Polyester Resin Dispersion Liquid 1 was replaced with Crystalline Polyester Resin Dispersion Liquid 2, and in the emulsifying process, the amounts of Pigment-Wax Dispersion Liquid, Prepolymer 2, and Crystalline Polyester Resin Dispersion Liquid 2 were changed to 677 parts, 122 parts, and 120 parts, respectively.

The obtained toner was evaluated in the same manner as in Example 1. The results are depicted in Table 1.

Example 6

Preparation of Toner

A beaker was charged with 500 parts of Non-Crystalline Polyester Resin Dispersion Liquid 3, 80 parts of Crystalline Polyester Resin Dispersion Liquid 2, 20 parts of pentaerythritol tetrabehenate (melting point: 81° C., melt viscosity: 25 mPa·s), and 4 parts of carbon black, and the mixture was stirred by a TK homomixer at 60° C., and 12,000 rpm, to uniformly dissolve and disperse the materials, to thereby obtain a toner material solution.

A separate beaker was charged with 706 parts of ion-exchanged water, 294 parts of 10% by mass hydroxyapatite suspension (SuperTite 10, manufactured by Nippon Chemical Industrial Co., Ltd.), and 0.2 parts of sodium dodecyl benzene sulfonate, and the mixture was homogenously dissolved. Then, the mixture was heated to 60° C., and the above-obtained toner material solution was added thereto with stirring by a TK homomixer at 12,000 rpm, followed by stirring for 10 minutes. Next, the resulting mixed solution was poured into a flask equipped with a stirring rod and a thermometer, and heated to 98° C. to remove the solvent, followed by being subjected to filtration, washing, drying, and air classification, to thereby obtain toner particles.

The obtained toner particles had the volume average particle diameter (Dv) of 6.2 μm, number average particle diameter (Dp) of 5.2 μm, and a ratio Dv/Dp of 1.19.

The toner particles (100 parts) were mixed with hydrophobic silica (0.5 parts) and hydrophobic titanium oxide (0.5 parts) by means of HENSCHEL MIXER, to thereby obtain Toner 6.

The obtained toner was evaluated in the same manner as in Example 1. The results are depicted in Table 1.

Example 7

Toner 7 was obtained in the same manner as in Example 2, provided that Unmodified Polyester Resin 2 was replaced with Unmodified Polyester Resin 4, and in the emulsifying process, the amounts of Pigment-Wax Dispersion Liquid, Prepolymer 2, and Crystalline Polyester Resin Dispersion Liquid 1 were changed to 677 parts, 122 parts, and 120 parts, respectively.

The obtained toner was evaluated in the same manner as in Example 1. The results are depicted in Table 1.

Example 8

Toner 8 was obtained in the same manner as in Example 2, provided that Unmodified Polyester Resin 2 was replaced with Unmodified Polyester Resin 4, and in the emulsifying process, the amounts of Pigment-Wax Dispersion Liquid, Prepolymer 2, and Crystalline Polyester Resin Dispersion Liquid 1 were changed to 680 parts, 109.4 parts, and 120 parts, respectively.

The obtained toner was evaluated in the same manner as in Example 1. The results are depicted in Table 1.

Example 9

Toner 9 was obtained in the same manner as in Example 2, provided that in the emulsifying process, the amounts of Pigment-Wax Dispersion Liquid, Prepolymer 2, and Crystalline Polyester Resin Dispersion Liquid 1 were changed to 677 parts, 122 parts, and 90 parts, respectively.

The obtained toner was evaluated in the same manner as in Example 1. The results are depicted in Table 1.

Example 10

A beaker was charged with 500 parts of Non-Crystalline Polyester Resin Dispersion Liquid 4, 90 parts of Crystalline Polyester Resin Dispersion Liquid 2, 20 parts of pentaerythritol tetrabehenate (melting point: 81° C., melt viscosity: 25 mPa·s), and 4 parts of carbon black, and the mixture was stirred by a TK homomixer at 60° C., and 12,000 rpm, to uniformly dissolve and disperse the materials, to thereby obtain a toner material solution.

A separate beaker was charged with 706 parts of ion-exchanged water, 294 parts of 10% by mass hydroxyapatite suspension (SuperTite 10, manufactured by Nippon Chemical Industrial Co., Ltd.), and 0.2 parts of sodium dodecyl benzene sulfonate, and the mixture was homogenously dissolved. Then, the mixture was heated to 60° C., and the above-obtained toner material solution was added thereto with stirring by a TK homomixer at 12,000 rpm, followed by stirring for 10 minutes. Next, the resulting mixed solution was poured into a flask equipped with a stirring rod and a thermometer, and heated to 98° C. to remove the solvent, followed by being subjected to filtration, washing, drying, and air classification, to thereby obtain toner particles.

The toner particles (100 parts) were mixed with hydrophobic silica (0.5 parts) and hydrophobic titanium oxide (0.5 parts) by means of HENSCHEL MIXER, to thereby obtain Toner 10.

The obtained toner was evaluated in the same manner as in Example 1. The results are depicted in Table 1.

Example 11

After sufficiently stirring and mixing by HENSCHEL MIXER a mixture consisting of 90 parts of Unmodified Polyester Resin 4, 10 parts of Unmodified Polyester Resin 6, 10 parts of Crystalline Polyester Resin 3, 3 parts of carnauba wax (EMUSTAR-0413, manufactured by Nippon Seiro Co., Ltd.), 8 parts of carbon black, and 3 parts of a metal-containing azo compound (BONTRON S-34, manufactured by ORIENT CHEMICAL INDUSTRIES CO., LTD), the resulting mixture was heated and melted by means of a roll-mill for about 30 minutes at the temperature of 100° C. to 110° C. Then, the resulting kneaded product was cooled to room temperature, and coarsely pulverized by a hammer mill into 200 μm to 400 μm, followed by subjected to classification with an IDS-2 pulverization classification device (manufactured by Nippon Pneumatic Mfg. Co., Ltd.), which integrally contained a fine pulverizer configured to finely pulverize a coarsely pulverized product by making the product directly hit an impact board using a jet stream, and an air classification device configured to generate swirling flow of the finely pulverized product in a classification chamber, and to classify the pulverized product by centrifugal separation. After the classification, a toner was obtained.

To the toner (100 parts) obtained after the classification, 1.0 part of external additives (R972, manufactured by Nippon Aerosil Co., Ltd.) was added. The mixture was stirred and mixed by HENSCHEL MIXER, and passed through a mesh to remove particles of large particle diameters, to thereby obtain Toner 11.

The obtained toner was evaluated in the same manner as in Example 1. The results are depicted in Table 1.

Example 12

Toner 12 was obtained in the same manner as in Example 10, provided that Non-Crystalline Polyester Resin Dispersion Liquid 4 was replaced with Non-Crystalline Polyester Resin Dispersion Liquid 5.

The obtained toner was evaluated in the same manner as in Example 1. The results are depicted in Table 1.

Example 13

Toner 13 was obtained in the same manner as in Example 10, provided that Non-Crystalline Polyester Resin Dispersion Liquid 4 was replaced with Non-Crystalline Polyester Resin Dispersion Liquid 6, and the amount of Crystalline Polyester Resin Dispersion Liquid 2 was changed to 100 parts.

The obtained toner was evaluated in the same manner as in Example 1. The results are depicted in Table 1.

Example 14

Toner 14 was obtained in the same manner as in Example 10, provided that Non-Crystalline Polyester Resin Dispersion Liquid 4 was replaced with Non-Crystalline Polyester Resin Dispersion Liquid 7, and the amount of Crystalline Polyester Resin Dispersion Liquid 2 was changed to 80 parts.

The obtained toner was evaluated in the same manner as in Example 1. The results are depicted in Table 1.

Comparative Example 1

Toner 15 was obtained in the same manner as in Example 2, provided that Unmodified Polyester Resin 2 was replaced with Unmodified Polyester Resin 4, Crystalline Polyester Resin Dispersion Liquid 1 was replaced with Crystalline Polyester Resin Dispersion Liquid 2, and in the emulsifying process, the amounts of Pigment-Wax Dispersion Liquid, Prepolymer 2, and Crystalline Polyester Resin Dispersion Liquid 2 were changed to 612 parts, 178 parts, and 180 parts, respectively. The obtained toner was evaluated in the same manner as in Example 1. The results are depicted in Table 1.

Comparative Example 2

After sufficiently stirring and mixing by HENSCHEL MIXER a mixture consisting of 100 parts of Non-Crystalline Polyester Resin 2, 3 parts of carnauba wax (EMUSTAR-0413, manufactured by Nippon Seiro Co., Ltd.), 8 parts of carbon black, and 3 parts of a metal-containing azo compound (BONTRON S-34, manufactured by ORIENT CHEMICAL INDUSTRIES CO., LTD), the resulting mixture was heated and melted by means of a roll-mill for about 30 minutes at the temperature of 130° C. to 140° C. Then, the resulting kneaded product was cooled to room temperature, and coarsely pulverized by a hammer mill into 200 gm to 400 μm, followed by classification with an IDS-2 pulverization classification device (manufactured by Nippon Pneumatic Mfg. Co., Ltd.), which integrally contained a fine pulverizer configured to finely pulverize a coarsely pulverized product by making the product directly hit an impact board using a jet stream, and an air classification device configured to generate swirling flow of the finely pulverized product in a classification chamber, and to classify the pulverized product by centrifugal separation. After the classification, a toner was obtained.

To the toner (100 parts) obtained after the classification, 1.0 part of external additives (R972, manufactured by Nippon Aerosil Co., Ltd.) was added. The mixture was stirred and mixed by HENSCHEL MIXER, and passed through a mesh to remove particles of large particle diameters, to thereby obtain Toner 16.

The obtained toner was evaluated in the same manner as in Example 1. The results are depicted in Table 1.

Comparative Example 3

Toner 17 was obtained in the same manner as in Example 2, provided that Unmodified Polyester Resin 2 was replaced with Unmodified Polyester Resin 3, and in the emulsifying process, the amounts of Pigment-Wax Dispersion Liquid, Prepolymer 2, and Crystalline Polyester Resin Dispersion Liquid 1 were changed to 630 parts, 158 parts, and 120 parts, respectively.

The obtained toner was evaluated in the same manner as in Example 1. The results are depicted in Table 1.

TABLE 1

| | Toner | Crystalline polyester resin | Unmodified polyester resin | Ta [° C.] | Tb [° C.] | Tb – Ta [° C.] | Low temperature fixing ability | Heat resistance storage stability | Image maintainability |
|---|---|---|---|---|---|---|---|---|---|
| Ex. 1 | 1 | 1 | 1 | 50 | 58 | 8 | B | A | A |
| Ex. 2 | 2 | 1 | 2 | 38 | 46 | 8 | B | A | B |
| Ex. 3 | 3 | 2 | 3 | 32 | 42 | 10 | A | A | A |
| Ex. 4 | 4 | 2 | 2 | 31 | 46 | 15 | A | A | A |

TABLE 1-continued

| | Toner | Crystalline polyester resin | Unmodified polyester resin | Ta [° C.] | Tb [° C.] | Tb − Ta [° C.] | Low temperature fixing ability | Heat resistance storage stability | Image maintainability |
|---|---|---|---|---|---|---|---|---|---|
| Ex. 5 | 5 | 2 | 1 | 35 | 57 | 22 | A | B | A |
| Ex. 6 | 6 | 2 | 1 | 55 | 65 | 10 | B | A | A |
| Ex. 7 | 7 | 1 | 4 | 40 | 65 | 25 | A | B | A |
| Ex. 8 | 8 | 1 | 4 | 45 | 64 | 19 | A | A | A |
| Ex. 9 | 9 | 1 | 2 | 37 | 53 | 16 | A | A | A |
| Ex. 10 | 10 | 2 | 1/5 | 39 | 55 | 16 | A | A | A |
| Ex. 11 | 11 | 3 | 4/6 | 52 | 63 | 11 | A | A | A |
| Ex. 12 | 12 | 2 | 1/7 | 37 | 56 | 19 | A | A | A |
| Ex. 13 | 13 | 2 | 4/7 | 35 | 60 | 25 | A | B | A |
| Ex. 14 | 14 | 2 | 1/6 | 45 | 54 | 9 | B | A | A |
| Comp. Ex. 1 | 15 | 2 | 4 | 30 | 68 | 28 | B | D | C |
| Comp. Ex. 2 | 16 | None | 2 | 60 | 63 | 3 | D | A | A |
| Comp. Ex. 3 | 17 | 1 | 3 | 25 | 40 | 15 | A | D | C |

The toners of Examples 1 to 14 of the invention were excellent in all of the low temperature fixing ability, heat resistance storage stability, and image maintainability. Especially, the toners of Example 3, 4, 8, 9, 10, 11, and 12 are remarkably excellent in all of the low temperature fixing ability, heat resistance storage stability, and image maintainability.

On the other hand, the toner of Comparative Example 1 had the high value of Tb−Ta, i.e., 28° C., and had poor heat resistance storage stability, and insufficient image maintainability. The toner of Comparative Example 2 had high Ta, and low value of Tb−Ta, and had poor low temperature fixing ability. The toner of Comparative Example 3 had low Ta, i.e., 25° C., and had poor heat resistance storage stability, and insufficient image maintainability.

INDUSTRIAL APPLICABILITY

The toner of the present invention has excellent low temperature fixing ability, heat resistance storage stability, and image maintainability, hence it is suitably used in image formation of energy saving. Moreover, the developer, image forming apparatus, and image forming method of the present invention, in all of which use the toner of the present invention, are suitably used in electrophotographic image formation of energy saving.

REFERENCE SIGNS LIST

10 photoconductor (photoconductor drum)
10K photoconductor for black
10Y photoconductor for yellow
10M photoconductor for magenta
10C photoconductor for cyan
14 support roller
15 support roller
16 support roller
17 intermediate transfer member cleaning device
18 image forming unit
20 charging roller
21 exposing device
22 secondary transfer device
23 roller
24 secondary transfer belt
25 fixing device
26 fixing belt
27 pressure roller
28 sheet reverser
30 exposing device
32 contact glass
33 first carriage
34 second carriage
35 image formation lens
36 read sensor
40 developing device
41 developing belt
42K developer-retention section
42Y developer-retention section
42M developer-retention section
42C developer-retention section
43K developer supply roller
43Y developer supply roller
43M developer supply roller
43C developer supply roller
44K developing roller
44Y developing roller
44M developing roller
44C developing roller
45K black developing unit
45Y yellow developing unit
45M magenta developing unit
45C cyan developing unit
49 registration roller
50 intermediate transfer member
51 roller
53 manual feeder path
54 manual-feeding tray
55 switch craw
56 ejecting roller
57 output tray
58 corona charger
60 cleaning device
61 developing device
62 transfer charger
63 photoconductorcleaning device
64 diselectrification unit
70 diselectrification lamp
80 transfer roller
90 cleaning device
95 transfer paper
100 color image forming apparatus
120 tandem developing device
130 document table
142 feeding roller

143 paper bank
144 feeder cassette
145 separation roller
146 feeder path
147 transport roller
148 feeder path
150 apparatus main body
160 charging device
200 feeding table
300 scanner
400 automatic document feeder
P transfer paper
T toner

The invention claimed is:

1. A toner comprising:

a binder resin comprising a crystalline polyester resin and a modified polyester resin;

a colorant; and wax, wherein the modified polyester resin comprises at least one member selected from urea-modified polyester resin, urethane-modified polyester resin, styrene-modified polyester resin, acryl-modified polyester resin, and silicone modified polyester resin, wherein the modified polyester resin is obtained by reacting bisphenol A ethylene oxide adduct, bisphenol A propylene oxide adduct and trimellitic acid as a monomer, and wherein the toner has Ta of from 30° C. to 55° C., and a Tb−Ta of from 8° C. to 25° C., Ta is a glass transition temperature of the toner determined from a constant heating component of a DSC curve of the toner obtained in a second heating process of temperature modulated differential scanning calorimetry, in which the temperature modulated differential scanning calorimetry is performed by a process comprising:

heating the toner from 0° C. to 150° C. at a heating rate of 3° C./min, and a modulation cycle of 0.5° C./60 sec;

cooling from 150° C. to 0° C. at a cooling rate of 20° C./min, and a modulation cycle of 0.5° C./60 sec; and then heating from 0° C. to 150° C. at a heating rate of 3° C./min, and a modulation cycle of 0.5° C./60 sec, Tb is a glass transition temperature of the toner determined from a constant heating component of a DSC curve of the toner obtained in a first heating process of temperature modulated differential scanning calorimetry, in which after heating the toner to 150° C. at a heating rate of 10° C./min by a differential scanning calorimeter, self-cooling, and leaving the toner to stand for 1 month, the temperature modulated differential scanning calorimetry is performed by a process comprising heating the toner from 0° C. to 150° C. at a heating rate of 3° C./min, and a modulation cycle of 0.5° C./60 sec.

2. The toner according to claim 1, wherein the toner has a Tb−Ta of from 10° C. to 20° C.

3. The toner according to claim 1, wherein the polyester resin comprising the chloroform insoluble component comprises the chloroform insoluble component in an amount of from 10% by mass to 40% by mass.

4. An image forming apparatus, comprising:

a latent electrostatic image bearing member;

a latent electrostatic image forming unit configured to form a latent electrostatic image on the latent electrostatic image bearing member;

a developing unit configured to develop the latent electrostatic image with a toner to form a visible image;

a transferring unit configured to transfer the visible image to a recording medium; and a fixing unit configured to fix the transferred image onto the recording medium, wherein the toner comprises:

a binder resin comprising a crystalline polyester resin and a modified polyester resin;

a colorant; and wax, wherein the modified polyester resin comprises at least one member selected from urea-modified polyester resin, urethane-modified polyester resin, styrene-modified polyester resin, acryl-modified polyester resin, and silicone modified polyester resin, wherein the modified polyester resin is obtained by reacting bisphenol A ethylene oxide adduct, bisphenol A propylene oxide adduct and trimellitic acid as a monomer, and wherein the toner has Ta of from 30° C. to 55° C., and a Tb−Ta of from 8° C. to 25° C., Ta is a glass transition temperature of the toner determined from a constant heating component of a DSC curve of the toner obtained in a second heating process of temperature modulated differential scanning calorimetry, in which the temperature modulated differential scanning calorimetry is performed by a process comprising:

heating the toner from 0° C. to 150° C. at a heating rate of 3° C./min, and a modulation cycle of 0.5° C./60 sec;

cooling from 150° C. to 0° C. at a cooling rate of 20° C./min, and a modulation cycle of 0.5° C./60 sec; and then heating from 0° C. to 150° C. at a heating rate of 3° C./min, and a modulation cycle of 0.5° C./60 sec, Tb is a glass transition temperature of the toner determined from a constant heating component of a DSC curve of the toner obtained in a first heating process of temperature modulated differential scanning calorimetry, in which after heating the toner to 150° C. at a heating rate of 10° C./min by a differential scanning calorimeter, self-cooling, and leaving the toner to stand for 1 month, the temperature modulated differential scanning calorimetry is performed by a process comprising heating the toner from 0° C. to 150° C. at a heating rate of 3° C./min, and a modulation cycle of 0.5° C./60 sec.

5. An image forming method, comprising:

forming a latent electrostatic image on a latent electrostatic image bearing member;

developing the latent electrostatic image with a toner to form a visible image;

transferring the visible image to a recording medium; and fixing the transferred image onto the recording medium, wherein the toner comprises:

a binder resin comprising a crystalline polyester resin and a modified polyester resin;

a colorant; and wax, wherein the modified polyester resin comprises at least one member selected from urea-modified polyester resin, urethane-modified polyester resin, styrene-modified polyester resin, acryl-modified polyester resin, and silicone modified polyester resin, wherein the modified polyester resin is obtained by reacting bisphenol A ethylene oxide adduct, bisphenol A propylene oxide adduct and trimellitic acid as a monomer, and wherein the toner has Ta of from 30° C. to 55° C., and a Tb−Ta of from 8° C. to 25° C., Ta is a glass transition temperature of the toner determined from a constant heating component of a DSC curve of the toner obtained in a second heating process of temperature modulated differential scanning calorimetry, in which the temperature modulated differential scanning calorimetry is performed by a process comprising:

heating the toner from 0° C. to 150° C. at a heating rate of 3° C./min, and a modulation cycle of 0.5° C./60 sec;

cooling from 150° C. to 0° C. at a cooling rate of 20° C./min, and a modulation cycle of 0.5° C./60 sec; and then heating from 0° C. to 150° C. at a heating rate of 3° C./min, and a modulation cycle of 0.5° C./60 sec, Tb is a glass transition temperature of the toner determined from a constant heating component of a DSC curve of the toner obtained in a first heating process of temperature modulated differential scanning calorimetry, in which after heating the toner to 150° C. at a heating rate of 10° C./min by a differential scanning calorimeter, self-cooling, and leaving the toner to stand for 1 month, the temperature modulated differential scanning calorimetry is performed by a process comprising heating the toner from 0° C. to 150° C. at a heating rate of 3° C./min, and a modulation cycle of 0.5° C./60 sec.

6. The image forming apparatus according to claim 4, wherein the toner has a Tb−Ta of from 10° C. to 20° C.

7. The image forming apparatus according to claim 4, wherein the polyester resin comprising the chloroform insoluble component comprises the chloroform insoluble component in an amount of from 10% by mass to 40% by mass.

8. The image forming method according to claim 5, wherein the toner has a Tb−Ta of from 10° C. to 20° C.

9. The image forming method according to claim 5, wherein the polyester resin comprising the chloroform insoluble component comprises the chloroform insoluble component in an amount of from 10% by mass to 40% by mass.

10. The toner according to claim 1, wherein the binder resin further comprises a polyester resin comprising a chloroform insoluble component.

11. The image forming apparatus according to claim 4, wherein the binder resin further comprises a polyester resin comprising a chloroform insoluble component.

12. The image forming method according to claim 5, wherein the binder resin further comprises a polyester resin copmrising a chloroform insoluble component.

13. The toner according to claim 1, wherein the crystalline polyester resin is obtained by reacting a carboxylic acid component and an alcohol component;

wherein the carboxylic acid component is selected from 1,8-octanedioic acid, 1,10-decanedioic acid and terephthalic acid, and the alcohol component is selected from 1,8-octanediol and 1,6-hexanediol.

14. The image forming apparatus according to claim 4, wherein the crystalline polyester resin is obtained by reacting a carboxylic acid component and an alcohol component;

wherein the carboxylic acid component is selected from 1,8-octanedioic acid, 1,10-decanedioic acid and terephthalic acid, and the alcohol component is selected from 1,8-octanediol and 1,6-hexanediol.

15. The image forming method according to claim 5, wherein the crystalline polyester resin is obtained by reacting a carboxylic acid component and an alcohol component;

wherein the carboxylic acid component is selected from 1,8-octanedioic acid, 1,10-decanedioic acid and terephthalic acid, and the alcohol component is selected from 1,8-octanediol and 1,6-hexanediol.

* * * * *